US012201918B2

(12) United States Patent
Ho

(10) Patent No.: US 12,201,918 B2
(45) Date of Patent: Jan. 21, 2025

(54) ADJUSTABLE BRIGHTNESS FLYING DISC

(71) Applicants: TOPIO LLC., Dover, DE (US); Hoang Vinh Ho, Hanoi (VN)

(72) Inventor: Hoang Vinh Ho, Hanoi (VN)

(73) Assignees: TOPIO LLC., Dover, DE (US); Hoang Vinh Ho, Hanoi (VN)

( * ) Notice: Subject to any disclaimer, the term of this patent is extended or adjusted under 35 U.S.C. 154(b) by 279 days.

(21) Appl. No.: 17/874,047

(22) Filed: Jul. 26, 2022

(65) Prior Publication Data

US 2023/0037021 A1 Feb. 2, 2023

Related U.S. Application Data

(60) Provisional application No. 63/203,629, filed on Jul. 27, 2021.

(51) Int. Cl.
*A63H 33/18* (2006.01)

(52) U.S. Cl.
CPC ..... *A63H 33/18* (2013.01)

(58) Field of Classification Search
CPC ..... A63H 33/18
See application file for complete search history.

(56) References Cited

U.S. PATENT DOCUMENTS 2,744,976 A 5/1956 Black
3,786,246 A 1/1974 Johnson et al.
3,798,834 A 3/1974 Samuel
3,812,614 A 5/1974 Harrington
4,080,753 A * 3/1978 Hiner ..... A63H 33/18 473/588

(Continued)

FOREIGN PATENT DOCUMENTS

CN 2274511 Y 2/1998
CN 2460151 Y 11/2001

(Continued)

OTHER PUBLICATIONS

Fishpond.com. Flying Ring Frisbee. Retrieved from: https://www.fishpond.com/Toys/3x-Flying-Ring-Frisbee, 9 pages.

(Continued)

*Primary Examiner* — John A Ricci
(74) *Attorney, Agent, or Firm* — Morrison & Foerster LLP

(57) ABSTRACT

Disclosed herein is an adjustable brightness flying suitable for both recreational and professional uses. The flying disc may comprise a light strip that illuminates when in use. In some embodiments, one or more properties of the light strip can be dynamically adjusted based on the intended application, environmental lighting conditions, and/or the player's preferences. The flying disc may have high-impact resistance, sand resistance, and/or water resistance so that it can be used for different applications and in different environments such as rough terrain, dusty environments, and/or in water. The flying disc may automatically detect a motion state and turn the light strip on or off accordingly. The illumination allows players to use the flying disc for different applications and in different environments, such as in low-lighting conditions. In some embodiments, the brightness may be adjusted and on-time of the light strip may be manually set or adjusted by a player.

19 Claims, 20 Drawing Sheets

(56) References Cited

U.S. PATENT DOCUMENTS

| | | | | |
|---|---|---|---|---|
| 4,135,324 | A | 1/1979 | Miller et al. | |
| 4,297,809 | A | 11/1981 | Branson | |
| 4,301,616 | A | 11/1981 | Gudgel | |
| 4,431,196 | A | 2/1984 | Kutnyak | |
| 4,435,917 | A | 3/1984 | Lee | |
| D274,142 | S | 6/1984 | Mcnab | |
| 4,563,160 | A | 1/1986 | Lee | |
| 4,669,995 | A | 6/1987 | Lombard | |
| D295,970 | S | 5/1988 | Mcnab | |
| 4,778,428 | A | 10/1988 | Wield | |
| 4,944,707 | A | 7/1990 | Silverglate | |
| D312,103 | S | 11/1990 | Lenox | |
| 5,032,098 | A | 7/1991 | Balogh | |
| 5,319,531 | A | 6/1994 | Kutnyak | |
| D354,525 | S | 1/1995 | Sullivan | |
| 5,611,720 | A | 3/1997 | Vandermaas | |
| 5,630,742 | A | 5/1997 | Honaker | |
| D386,221 | S | 11/1997 | Ybanez | |
| D386,223 | S | 11/1997 | Imai | |
| D390,282 | S | 2/1998 | Burdick | |
| 5,720,651 | A | 2/1998 | Chien | |
| 5,800,237 | A | 9/1998 | Cummings | |
| 6,113,453 | A | 9/2000 | Stuffelbeam | |
| 6,175,196 | B1 | 1/2001 | Ragner | |
| 6,247,989 | B1 | 6/2001 | Neff | |
| 6,547,623 | B1 | 4/2003 | Collado | |
| 6,682,384 | B2 | 1/2004 | Wang | |
| 6,726,521 | B2 | 4/2004 | Peterson | |
| 6,764,371 | B2 | 7/2004 | Hartman et al. | |
| 6,783,421 | B1 * | 8/2004 | Lopez | A63H 23/10 446/485 |
| 6,857,770 | B2 | 2/2005 | Moore | |
| D503,953 | S | 4/2005 | Holgate | |
| 7,037,169 | B2 | 5/2006 | Benedek | |
| 7,270,588 | B2 * | 9/2007 | Frazier | A63H 33/18 473/589 |
| 7,347,758 | B2 | 3/2008 | Moore | |
| 7,766,718 | B2 | 8/2010 | Rago | |
| D626,057 | S | 10/2010 | Calvin | |
| 8,142,295 | B2 | 3/2012 | Mesika | |
| 8,157,607 | B2 | 4/2012 | Cowles | |
| D659,812 | S | 5/2012 | Shek | |
| D683,516 | S | 6/2013 | Elias | |
| 8,608,598 | B2 | 12/2013 | Hoang | |
| 8,858,289 | B2 | 10/2014 | Forte | |
| 9,320,981 | B2 | 4/2016 | Dawson | |
| 9,550,566 | B2 | 1/2017 | Henning, Jr. | |
| D778,370 | S | 2/2017 | Moore | |
| D859,536 | S | 9/2019 | Cope | |
| D860,332 | S | 9/2019 | Cope | |
| 11,037,322 | B2 * | 6/2021 | Hildreth | A63H 33/18 |
| 11,161,053 | B2 * | 11/2021 | Phipps | H04R 1/403 |
| 11,612,828 | B2 * | 3/2023 | Kocking | A63H 33/18 446/46 |
| 11,786,801 | B2 | 10/2023 | Gayton | |
| 2003/0162470 | A1 | 8/2003 | Peterson | |
| 2003/0186615 | A1 | 10/2003 | Wang | |
| 2004/0043694 | A1 | 3/2004 | Cohen | |
| 2004/0220001 | A1 * | 11/2004 | Oister | A63B 37/0024 473/588 |
| 2007/0212973 | A1 * | 9/2007 | Brockes | A63H 33/18 446/47 |
| 2009/0004945 | A1 * | 1/2009 | deLassus | A63H 33/18 446/46 |
| 2011/0053716 | A1 * | 3/2011 | Lewis | A63H 33/18 473/588 |
| 2011/0074109 | A1 | 3/2011 | Werth | |
| 2016/0136517 | A1 | 5/2016 | Putland | |
| 2018/0181654 | A1 | 6/2018 | Young | |
| 2019/0383450 | A1 | 12/2019 | Meir | |
| 2022/0314137 | A1 | 10/2022 | Liao | |
| 2022/0410026 | A1 | 12/2022 | Sacha | |
| 2024/0075400 | A1 | 3/2024 | Hoang | |
| 2024/0246004 | A1 | 7/2024 | Hofstede | |
| 2024/0252947 | A1 | 8/2024 | Lin | |

FOREIGN PATENT DOCUMENTS

| | | | |
|---|---|---|---|
| CN | 200957298 | Y | 10/2007 |
| CN | 201969354 | U | 9/2011 |
| CN | 302620087 | S | 10/2013 |
| CN | 302695825 | | 12/2013 |
| CN | 306714415 | S | 7/2021 |
| CN | 308198909 | S | 8/2023 |
| DE | 8617420 | U | 12/1986 |
| DE | 19649794 | C2 | 8/1999 |
| DE | 102005045494 | A1 | 5/2006 |
| FR | 3121846 | A3 | 10/2022 |
| JP | 2016-221202 | A | 12/2016 |
| KR | 20-0244774 | Y1 | 10/2001 |
| RU | 2794976 | C1 | 4/2023 |
| WO | 99/24134 | A1 | 5/1999 |
| WO | 2009/049329 | A1 | 4/2009 |

OTHER PUBLICATIONS

Ho, Office Action dated Apr. 24, 2024, directed to U.S. Appl. No. 18/512,847; 19 pages.

Ho, Office Action dated Feb. 15, 2024, directed to U.S. Appl. No. 18/307,667; 7 pages.

Ho, Office Action dated Jan. 12, 2024, directed to U.S. Appl. No. 18/512,847; 19 pages.

Ho, Office Action dated Mar. 21, 2024, directed to U.S. Appl. No. 29/917,714; 9 pages.

International Search Report and Written Opinion mailed Mar. 8, 2024, directed to International Application No. PCT/US2023/080309; 13 pages.

TOSY Flying Ring. By TOSY Story. Dated Nov. 30, 2023. Found online [Mar. 14, 2024]. https://www.amazon.com/TOSY-Flying-Ring-Waterproof-Lightweight/dp/BOCMPBCDFM?th=1 (Year: 2023); 3 pages.

Ho, Office Action dated Jun. 27, 2024, directed to U.S. Appl. No. 29/917,714; 7 pages.

Ho, Office Action dated Jun. 3, 2024, directed to U.S. Appl. No. 18/307,667; 8 pages.

Ho, Office Action dated May 23, 2024, directed to U.S. Appl. No. 18/307,667; 9 pages.

Ho, U.S. Office Action mailed Aug. 14, 2024, directed to U.S. Appl. No. 18/512,847; 16 pages.

* cited by examiner

ADJUSTABLE BRIGHTNESS FLYING DISC

CROSS-REFERENCE TO RELATED APPLICATIONS

This application claims the benefit of U.S. Provisional Application No. 63/203,629, filed Jul. 27, 2021, the entire contents of which is incorporated herein by reference.

FIELD

The present disclosure relates to a flying disc equipped with an LED strip located around the rim, and more specifically to, an adjustable brightness flying disc.

BACKGROUND

A flying disc may be an aerodynamic object that flies through the air, typically used for a variety of purposes ranging from professional sports use to recreational use. The flying disc may have a round shape, allowing the player to hold its rim. The distance and path of the flying disc may be based on one or more properties of the player's wrist, arm, torso, or the like. For example, the flying disc may spin based on the player's wrist movement when throwing it.

It is estimated that at least a few million people participate in professional team sports that involve a flying disc, including various different types of teams such as ones playing locally in schools or clubs to regional, national, or international professional teams. Flying discs are also used recreationally at parks, beaches, backyards, etc. With widespread popularity, flying discs may be used in a variety of environments, for example, when bright-lighting conditions may be lacking, such as at night, in low-lighting weather conditions (cloudy or rainy weather), or in low-lighting venues (e.g., indoors). As another example, flying discs may be used in different settings, such as near water like at the beach. Thus, conventional flying discs may not be suitable for different applications (e.g., recreational and professional uses) and different environments (e.g., different weather conditions such as dark, rainy weather, in a forest, etc.). Further, conventional flying discs may not be capable of being dynamically adjustable for multiple environments. What is needed is a flying disc that is suitable for different types of uses and different environment. What is also needed is a flying disc that may be reconfigured.

In some instances, it may be important for a player to throw the flying disc with precision and accuracy. For example, disc golf (also known as Frisbee golf) is a flying disc game where players individually throw a flying disc at a target. The disc golf may be an aerodynamic object such as a round disc that is held at the rim by a player and then thrown using the player's movements of his or her wrist, arm, torso, etc. When the player throws the flying disc, it may fly through the air while spinning/rotating. The path and trajectory of the flying disc may be based on the player's spin and force. Since the player must throw the flying disc at a specific target, the precision and accuracy may affect whether the flying disc hits the target.

There are thousands of different types of golf discs on the market today. Each disc may have different properties, such as aerodynamics, shapes, weights, sizes, materials, flight characteristics, etc. The trajectory of the disc may depend on many factors including initial throwing speed, rotational speed when thrown, throw angle, wind speed, wind direction, etc. To throw the disc correctly, it is important for the player to understand how these factors affect the disc's trajectory. The player's understanding, however, may be based on a best guess, and thus, inaccurate. What is needed is a training tool that provides the user with information regarding the disc's trajectory and associated factors.

SUMMARY

Disclosed herein is an adjustable brightness flying disc and associated methods of operation and manufacture. The disclosed flying disc overcomes one or more of the above-mentioned problems. The flying disc may be suitable for both recreational and professional uses. The flying disc may comprise a light strip that illuminates when in use. In some embodiments, one or more properties (e.g., intensity, colors, patterns, etc.) of the light strip can be dynamically adjusted based on the intended application, environmental lighting conditions, the player's preferences, or a combination thereof. For example, the flying disc may have high-impact resistance, sand resistance, and/or water resistance so that it can be used for different applications and in different environments such as rough terrain, dusty environments, and/or in water.

The flying disc may operate in an automatic mode or a manual mode. In the automatic mode, a controller, with motion information from one or more motion sensors, may determine the motion state of the flying disc. Based on the motion state, the controller may turn off the light strip, or adjust the intensity of the light illuminated by the light strip. The controller may determine the flying disc is flying and may automatically turn on the light strip such that the flying disc lights up. The illumination allows players to use the flying disc for different applications and in different environments, such as in low-lighting conditions. In some embodiments, the brightness of the light strip may be adjusted according to detected light levels. Alternatively, the controller may determine the flying disc is not in motion and may automatically turn off the light strip so that power can be conserved. In the manual mode, a player may activate the light strip causing it to light up and may adjust the brightness time that it lights up using a timer button.

In some embodiments, the flying disc disclosed herein may track the motion information and provide it to a player so that the player can improve his or her performance. For example, the flying disc may track the information regarding the player's initial throwing speed, angle, and/or position. The flying disc may determine whether the trajectory or location of the flying disc meets one or more target trajectories and/or locations, and may provide the information to the player so that the player can adjust his or her movements.

A flying disc is disclosed. In some embodiments, the flying disc may comprise: a disc body comprising an upper shell and a lower surface connected by a rim; at least one light strip arranged on the rim, wherein the at least one light strip is configured to radiate outward in a radial direction from a center of the flying disc when the light strip is on; a light strip guard covering an outer surface of the at least one of light strip; a battery configured to provide power to the at least one light strip when on; and a controller configured to determine whether and an amount of power to provide to the at least one light strip. Additionally or alternatively, the flying disc may comprise: one or more electrical wires, wherein the controller communicates the amount of power from the battery to the at least one light strip using the one or more electrical wires. Additionally or alternatively, the flying disc may comprise: one or more light sensors, wherein the controller is configured to determine light levels of an environment based on information from the one or more light sensors and adjust the amount of power based on the determined light levels. Additionally or alternatively, the upper shell comprises a convex curvature and the lower shell comprises a concave curvature. Additionally or alternatively, the flying disc may comprise: a compartment comprising the controller and the battery, wherein the compartment is located at the center of the flying disc. Additionally or alternatively, the flying disc may comprise: at least one light strip is recessed into the rim. Additionally or alternatively, the flying disc may comprise: one or more motion sensors for determining one or more motion properties of the flying disc when thrown. Additionally or alternatively, the flying disc may comprise: one or more motion sensors comprise one or more of: an accelerometer, a gyroscope, a magnetometer, or a GPS sensor, and wherein the one or more motion properties comprises a position, a rotational velocity, an airspeed, or a trajectory. Additionally or alternatively, the controller is further configured to determine a time when the flying disc is in a certain state and provide one or more alerts in response to the time being greater than or equal to a time threshold. Additionally or alternatively, the flying disc may comprise: one or more centrifugal switches or accelerometer for sending an electrical signal when the flying disc is rotating, wherein the controller automatically turns on the at least one light strip in response to receiving the electrical signal. Additionally or alternatively, the flying disc may comprise: a timer button capable of being manipulated by a player, or other user such as a coach, to set or adjust a time period for illuminating the at least one light strip. Additionally or alternatively, the flying disc may comprise: a brightness selector button capable of being manipulated by a player, or other user such as a coach, to set or adjust a brightness level of the at least one light strip. Additionally or alternatively, the flying disc may comprise: a transmitter capable of communicating wired or wireless signals to an external device. Additionally or alternatively, the flying disc may comprise: a speaker configured to provide one or more audible signals. Additionally or alternatively, the flying disc may comprise: a circuit shell that is welded to the disc body causing the flying disc to be impact, sand, or water resistant. Additionally or alternatively, the battery is a rechargeable battery, the flying disc further comprises a charging port and a charging jack. Additionally or alternatively, the flying disc may comprise: the flying disc has an average density less than that of water. Additionally or alternatively, the at least one light strip comprises 6 to 1200 light emitting diodes (LEDs) arranged around the rim of the flying disc. Additionally or alternatively, the flying disc may comprise: the at least one light strip includes multi-colored light emitting diodes (LEDs). Additionally or alternatively, the flying disc may comprise: the disc body comprises one or more of: polypropylene (PP), low density polyethylene (LDPE), thermoplastic elastomer (TPE), polyurethane (PU), thermoplastic polyurethane (TPU), high-density polyethylene (HDPE), or thermoplastic elastomer (TPE); or wherein the light strip guard comprises one or more of: PP, LDPE, TPE, PU, or TPU.

It will be appreciated that any of the variations, aspects, features, and options described in view of the systems and methods apply equally to the methods and vice versa. It will also be clear that any one or more of the above variations, aspects, features, and options can be combined. It should be understood that the invention is not limited to the purposes mentioned above, but may also include other purposes, including those that can be recognized by one of ordinary skill in the art.

DETAILED DESCRIPTION

Figure 1:
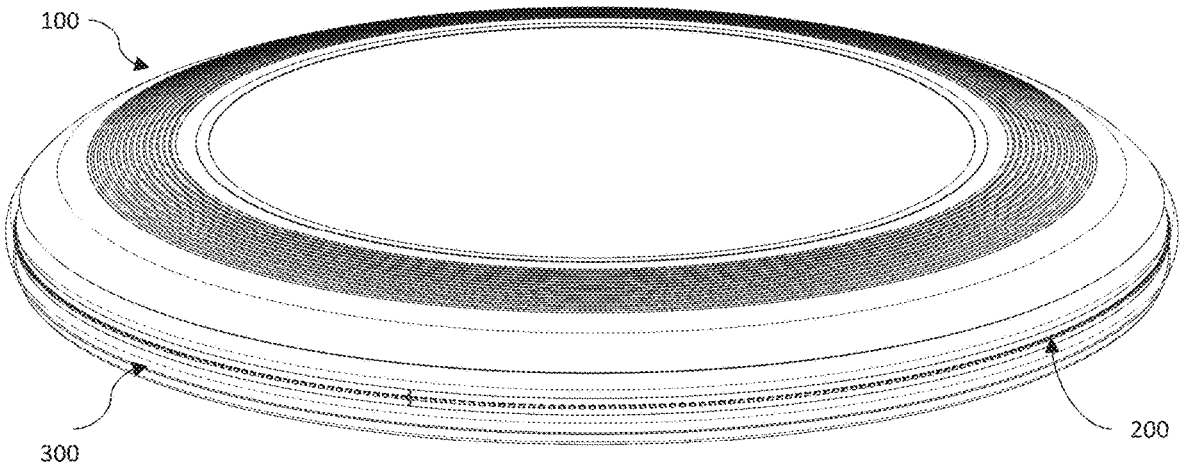
FIG. 1 illustrates a top-perspective view of an example flying disc, according to some embodiments.

Described herein is a brightness-adjustable flying disc. The flying disc may comprise at least one light strip located on the rim (e.g., outside perimeter) of the flying disc. The light strip may comprise a plurality of lights, e.g., light emitting diodes (LEDs) that form a bright circle that light ups while in motion. The flying disc may be used for different applications, such as for use in ultimate frisbee, disc golf, or other types (disc for throwing to a pet such as a dog, disc for freestyle enjoyment such as throwing back and forth at a park, etc.) The properties, including the brightness of the light illuminated from the flying disc, may be adjustable. In some embodiments, the flying disc may be configured to automatically turn on the light strip while in motion and turn off the light strip while stopped. Alternatively, the properties of the light strip may be manually set or adjusted by a player, or other user such as a coach.

The flying disc may also measure, store, and/or communicate one or more motion properties, such as the position, rotational velocity, airspeed, trajectory, or the like, of the flying disc. The motion information may be communicated to another device, such as a smart phone using wireless or wired communications.

The following description is presented to enable a person of ordinary skill in the art to make and use various embodiments. Descriptions of specific devices, techniques, and applications are provided only as examples. These examples are being provided solely to add context and aid in the understanding of the described examples. It will thus be apparent to a person of ordinary skill in the art that the described examples may be practiced without some or all of the specific details. Other applications are possible, such that the following examples should not be taken as limiting. Various modifications in the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various techniques and process flow steps will be described in detail with reference to examples as illustrated in the accompanying drawings. In the following description, numerous specific details are set forth in order to provide a thorough understanding of one or more aspects and/or features described or referenced herein. It will be apparent, however, to a person of ordinary skill in the art, that one or more aspects and/or features described or referenced herein may be practiced without some or all of these specific details. In other instances, well-known process steps and/or structures have not been described in detail in order to not obscure some of the aspects and/or features described or referenced herein.

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combination of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Figure 2:
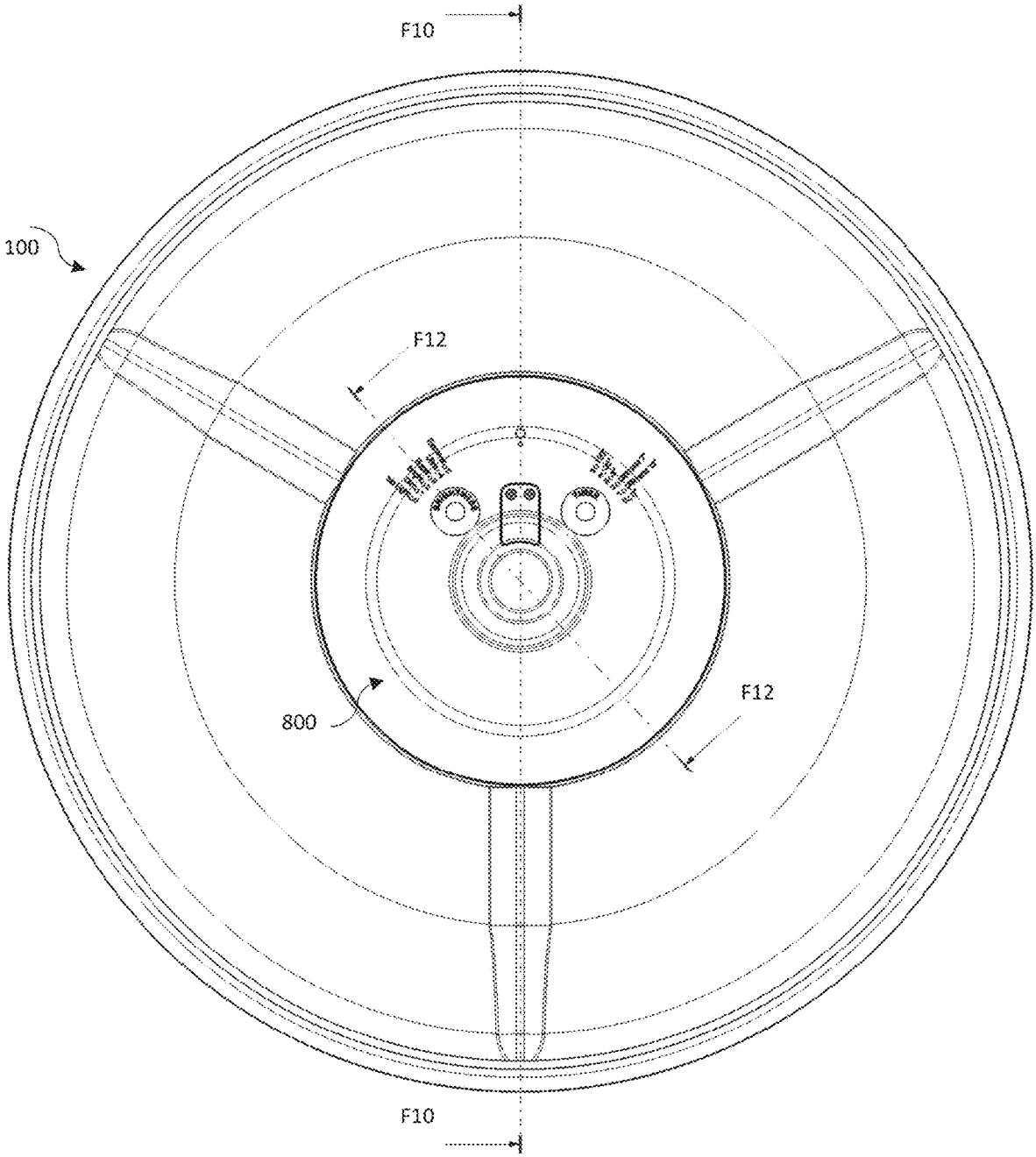
FIG. 2 illustrates a bottom view of an example flying disc, according to some embodiments.

FIGS. 1 and 2 illustrate top-perspective and bottom views, respectively, of an example flying disc, according to some embodiments. Flying disc 100 may comprise a light strip 200 and a light strip guard 300. The flying disc 100 comprises a disc body formed from an upper shell and a lower shell connected by a disc rim. The upper shell of the disc body may comprise a convex curvature, and the lower shell of the disc body may comprise a concave curvature. When connected together, the upper surface, lower surface, and disc rim may form a circular disc. The flying disc 100 may comprise any number of light strips 200, such as one light strip 200 arranged on the rim of the flying disc 100 so that it can radiate outward in the radial direction from the center of the flying disc 100. The light strip guard 300 may cover at least the outer surface of the light strip 200. In some embodiments, the light strip guard 300 may be integral with the disc body. The light strip guard 300 may be at least partially transparent such that light emitted by the light strip 200 can propagate outward.

In some embodiments, the flying disc 100 may have an average density less than that of water such that the flying disc 100 may be able to float on water. Additionally or alternatively, the flying disc may be sand or water proof. This may allow a player to play comfortably with the flying disc in water, dust, sand, or other types of environments.

The flying disc 100, including the shape and materials of its upper and lower shells and the location and weights of its inner components may be configured such that the center of rotation coincides with the center of the disc body and/or the flying disc travels with stability when flying. For example, although the figure illustrates convex and concave shells that may provide aerodynamic characteristics, embodiments of the disclosure may include shells having any type of shape. As another example, the structure and location of the controller, battery, and other components (discussed in more detail below) may be such that the center of inertia coincides with the axis of rotation of the flying disc.

Figure 3:
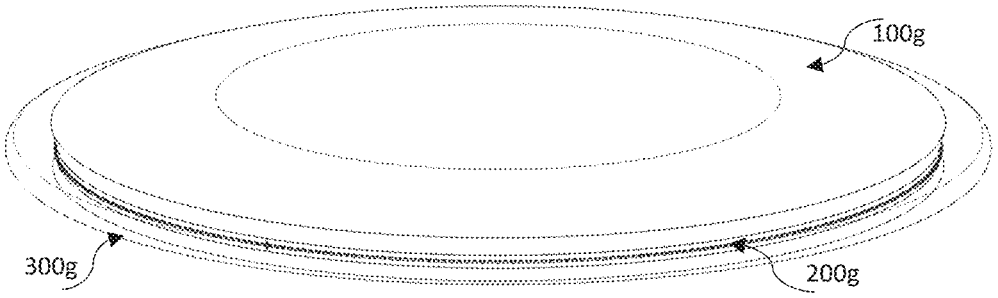
FIG. 3 illustrates a top-perspective view of an example flying disc for disc golf, according to some embodiments.
Figure 4:
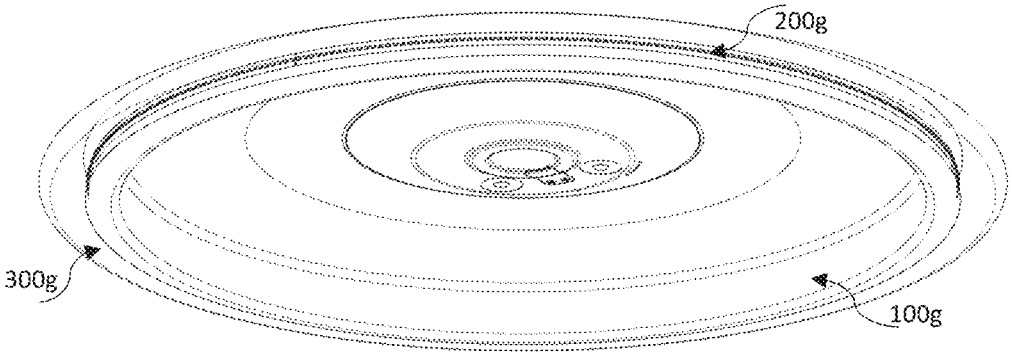
FIG. 4 illustrates a bottom-perspective view of an example flying disc for disc golf, according to some embodiments.
Figure 5:
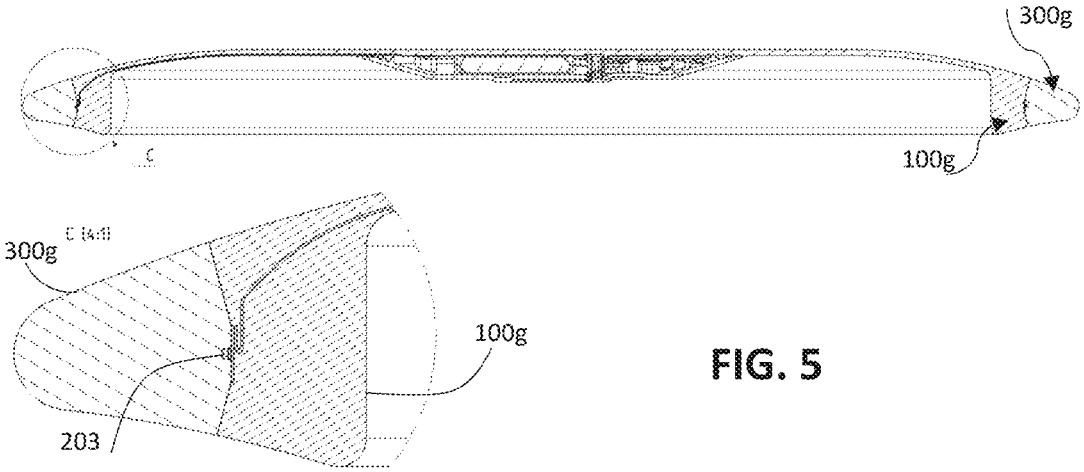
FIG. 5 illustrates a cross-sectional view of an example flying disc for disc golf, according to some embodiments.

The flying disc 100 may also be configured for different applications. For example, FIGS. 3-5 illustrate top-perspective, bottom-perspective, and cross-sectional views of an example flying disc for disc golf, according to some embodiments. The example flying disc for disc golf may have a disc body 100*g*, a light strip 200*g*, and a light strip guard 300*g* that have one or more properties similar to the disc body 100, light strip 200, and light strip guard 300 discussed in more detail below.

Figure 6:
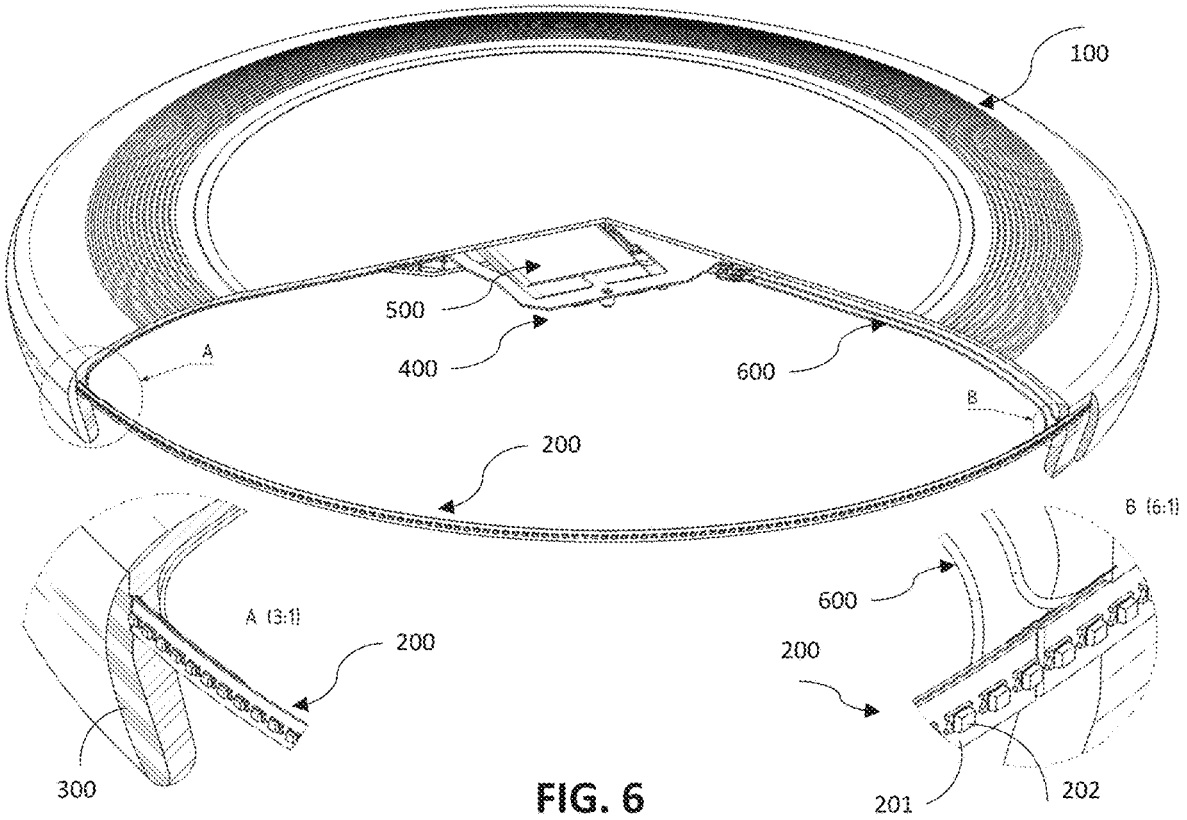
FIG. 6 illustrates a top-perspective view (including a partial cutout) of an example flying disc, according to some embodiments.
Figure 7:
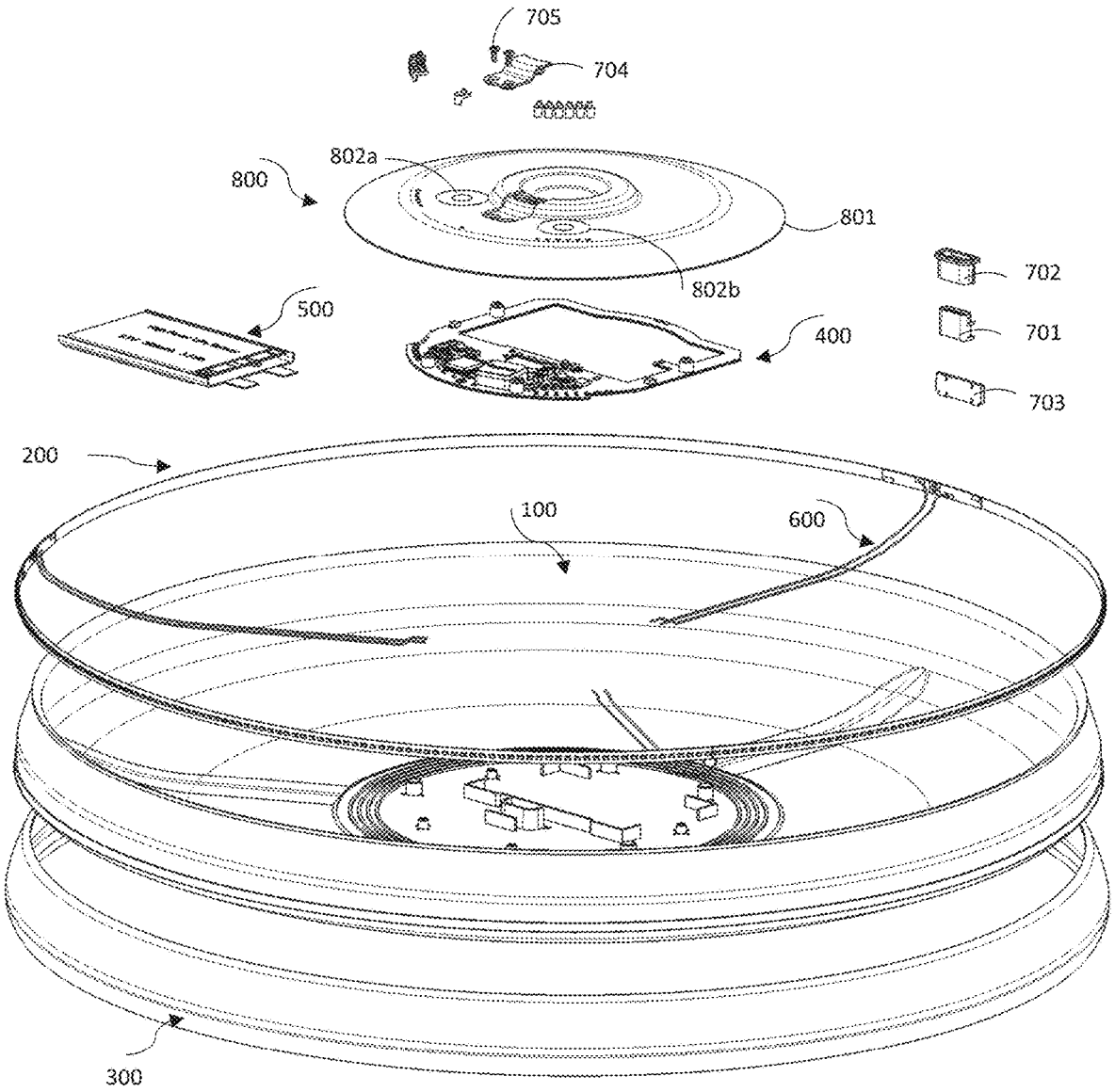
FIG. 7 illustrates an example flying disc, according to some embodiments.

FIG. 6 illustrates a top-perspective view (including a partial cutout) of an example flying disc, according to some embodiments. Flying disc 100 may comprise a light strip 200, a light strip guard 300, a controller 400, a battery 500, and one or more electrical wires 600, among others. The disc body of the flying disc 100 may comprise one or more lightweight, impact-resistant materials, such as polypropylene (PP), low density polyethylene (LDPE), thermoplastic elastomer (TPE), a similar material, or a combination of thereof. Additionally or alternatively, the disc body of the flying disc 100 may comprise one or more heavy, impact-resistant plastics, such as polyurethane (PU), thermoplastic polyurethane (TPU), high-density polyethylene (HDPE), thermoplastic elastomer (TPE), a similar material, or a combination thereof. In some embodiments, the disc body may comprise a water-resistant coating. In some embodiments, the water-resistant coating may be provided on the lower shell of the disc body to cover the compartment 800 that houses the controller 400 or other circuits.

The light strip 200 may be configured to radiate light outward in a radial direction from the center of the flying disc 100. The light strip 200 may be located along the rim of the flying disc 100. In some embodiments, the light strip 200 may comprise a strip of light emitting diodes (LEDs). The light emitted by the light strip 200 can transmit outward, such that the flying disc 100 may emit light at least partially around the rim of the flying disc 100, outward in the radial direction from the center of the flying disc. When configured to emit light, the light strip 200 may form a light trail around the outer rim of the flying disc 100. This lighting effect not only increases the player's enjoyment, but also provides light in low-lighting conditions, for example, at night. The light provided by the light strip 200 may allow the players to easily determine the position and movement of the flying disc 100 and/or a player. For example, when a first player is throwing the flying disc 100 to a second player, the second player may be able to determine where the first player is located and what the properties of the player's movement (e.g., wrist, arm, torso, etc.) were when throwing the flying disc 100. In some embodiments, the properties (e.g., intensity, color, pattern, etc.) of the light emitted by the light strip 200 may correspond to the properties of the first player's movements.

The controller 400 may located at the center of the flying disc 100. In some embodiments, the controller 400 may be located in a compartment (e.g., compartment 800 of FIG. 2) of the flying disc 100. The controller 400 may control the properties of the light emitted by the light strip 200 (discussed in more detail below). The controller 400 may receive one or more signals from one or more sensors (e.g., inertial measurement unit (IMUs)) and may send one or more control signals and/or power signals to the light strip 200. An IMU may be a 3- or 6-axis IMU. An IMU may determine the motion state of the flying disc 100. Exemplary motions may include, but are not limited to, flying, rotating, being held in a person's hand, lying on the ground, etc.

The flying disc 100 may include one or more motion sensors including, but not limited to, an accelerometer, gyroscope, magnetometer, GPS sensor, or the like. These motion sensors may measure motion information, such as flight trajectory, location, rotational speed, airspeed, etc. The motion information may be transmitted to an external device, such as a smartphone, to be saved and later accessed for analysis by one or more players. The transmission may be via a transmitter that communicates wired or wireless signals (e.g., Bluetooth, WiFi, etc.), for example, to an external device. In some embodiments, the flying disc may be capable of being located by an external device, such as when the flying disc is lost.

The controller 400 may receive power from a battery 500. The battery 500 may comprise a rechargeable battery. The rechargeable battery may comprise lithium batteries with high discharge current and high durability and capacity (e.g., lithium-polymer batteries). In some embodiments, the battery 500 may comprise one or more battery cells, preferably in a monolithic form to facilitate installation and replacement.

The battery 500 may be recharged, when needed, thereby providing convenience and cost savings to the players and extending the time of use. For example, as shown in FIGS. 7-10, the flying disc may comprise a charging port 700, which may comprise a charging jack 701, a waterproof gasket 702, charging port circuit 703 (e.g., a charging port PCB), a charging port dust cover 704, and a charging port cover screw 705, for charging the battery 500. In some embodiments, the battery 500 may be recharged using a USB type C charging port. The charging port 700 may be water-resistant or covered with a watertight lid.

In some embodiments, the controller 400 may determine when the flying disc 100 is in use (e.g., being thrown) and not in use (e.g., sitting on the ground) and control whether the light strip is on or off. In some embodiments, the controller 400 may automatically turn on and/or turn off the light strip 200. This automatic on/off feature may save and optimize battery usage. In some embodiments, the flying disc 200 may comprise one or more sensors (such as, but not limited to, a centrifugal switch and/or IMU) that controls the on/off state of the light strip 200. The movement (e.g., rotation) of the flying disc 100 may cause the centrifugal switch to close the circuit. When the centrifugal switch is in a closed state, it may automatically power at least one light strip 200.

The light strip 200 may be connected to the controller 400 using one or more electrical wires 600. In some embodiments, one or more signals may be sent through the electrical wire(s) 600. An electrical wire 600 may extend from the controller 400 (located at, e.g., the center of the flying disc 100 in a compartment 800) to the rim of the flying disc 100. The number of electrical wires 600 may depend on the number of LED colors and/or the number of LEDs. For example, a flying disc 100 having a monochromatic light strip 200 may comprise two electrical wires 600, and a flying discs 200 having red, green, and blue LEDs may comprise three or four electrical wires 600.

In some embodiments, the controller 400 may comprise a control circuit configured to determine the lighting conditions of the environment and adjust the properties of the light strip 200 accordingly. For example, the flying disc 100 may operate in an automatic mode, and the controller 400 may adjust the intensity of the emitted light according to the light levels of the environment, determined based on information from one or more light sensors. For example, the controller 400 may adjust the amount of power provided to the light strip 200. In some embodiments, the amount of power provided to the light strip 200 may be higher for bright-light conditions and lower for low-light conditions. In some embodiments, the properties (e.g., color, brightness, pattern, etc.) of the light strip 200 can be controlled automatically based on the information provided by one or more sensors such as an IMU sensor. In some embodiments, the flying disc 100 may operate in a manual mode, and a player's input may cause the controller 400 to adjust the properties of the light strip 200 according to the player's preference, such as a certain intensity of illumination. The player may provide the input, e.g., manually by pushing one or more buttons or via a wireless signal communicated to the flying disc 100 from another device (e.g., a smartphone). As another example, the player may control the disc by shaking and/or tapping the disc according to a predetermined movement pattern. The IMU sensors may detect this movement pattern, and the controller may control the light blocks 202 in the light strip 200 accordingly.

The light strip 200 made comprise a flexible circuit board 201 and a plurality of light blocks 202. The flexible circuit board 201 may comprise flexible material comprising sections of light blocks 202 spaced apart (sections without light blocks 202). The light blocks 202 may be spaced evenly around the rim of the flying disc 100, for example. In some embodiments, the light blocks 202 may comprise LEDs, LED assemblies, or LED microchips. A light block 202 may be mounted on the flexible circuit board 201 using any soft-circuit-suitable technology such as surface mount technology (SMT) or chip-on-board (COB). For example, the light blocks 202 may be inserted into a plastic flexible circuit board. In some embodiments, the light blocks may be inserted using a molding process and technology for high-impact resistance. In some embodiments, placing and mounting the light blocks 202 onto the flexible circuit board 201 may be automated. In some embodiments, segments of the light strip 200 may be soldered together. A flying disc 100 may comprise any number of segments including, but not limited to, 1 to 10. The soldered segments may help prevent the flexible circuit board 201 from being too long, which may lead to problems and inconveniences when the flying disc 100 is manufactured.

Figure 11:
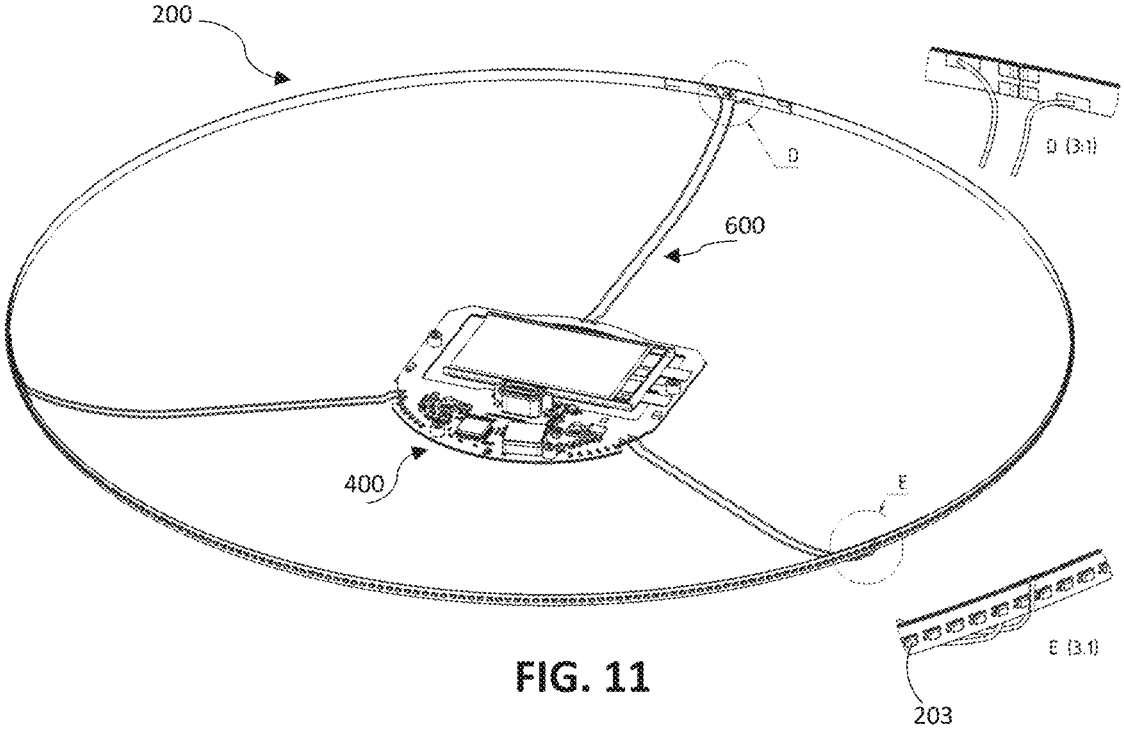
FIG. 11 illustrates a bottom-perspective view of an example flying disc comprising a large number of light blocks, according to some embodiments.
Figure 12:
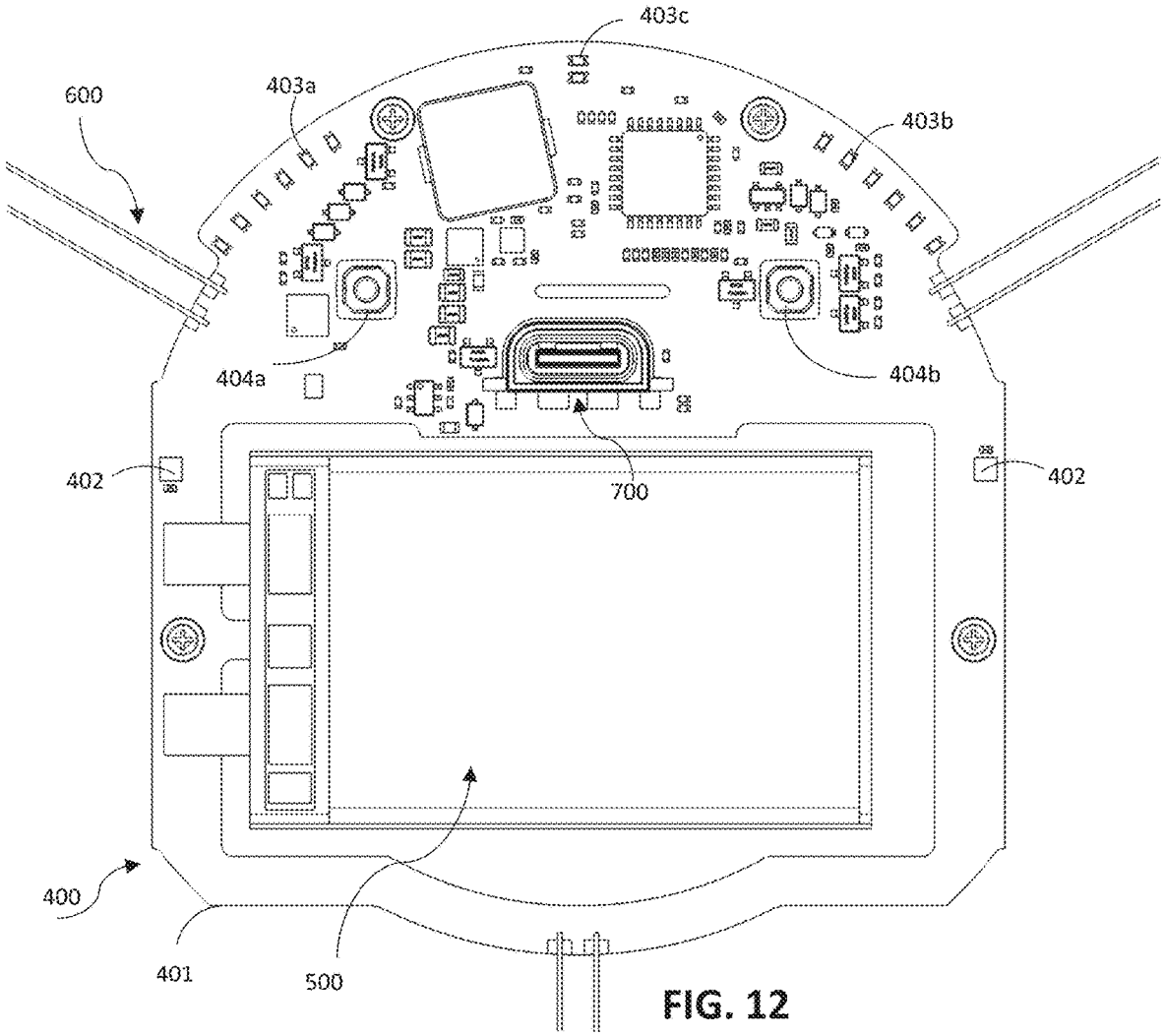
FIG. 12 illustrates an example controller for a flying disc comprising a large number of light blocks, according to some embodiments.

The number of light blocks 202 arranged on the entire light strip 200 may comprise any number of lights, such as 5-1500 lights. In some embodiments, the light strip 200 may comprise 6-1200 LEDs. FIG. 11 illustrates one non-limiting example flying disc comprising a large number (e.g., 360) of light blocks 203 (e.g., 360 LEDs). As shown in the figure, the flying disc comprises three sets of electrical wires 600 for connecting the controller 400 to a light strip 200. The sets of electrical wires 600 may be evenly radially-distributed along a shell of the flying disc 100. FIG. 12 illustrates an example controller 400 for a flying disc comprising a large number of light blocks, according to some embodiments.

Figure 13:
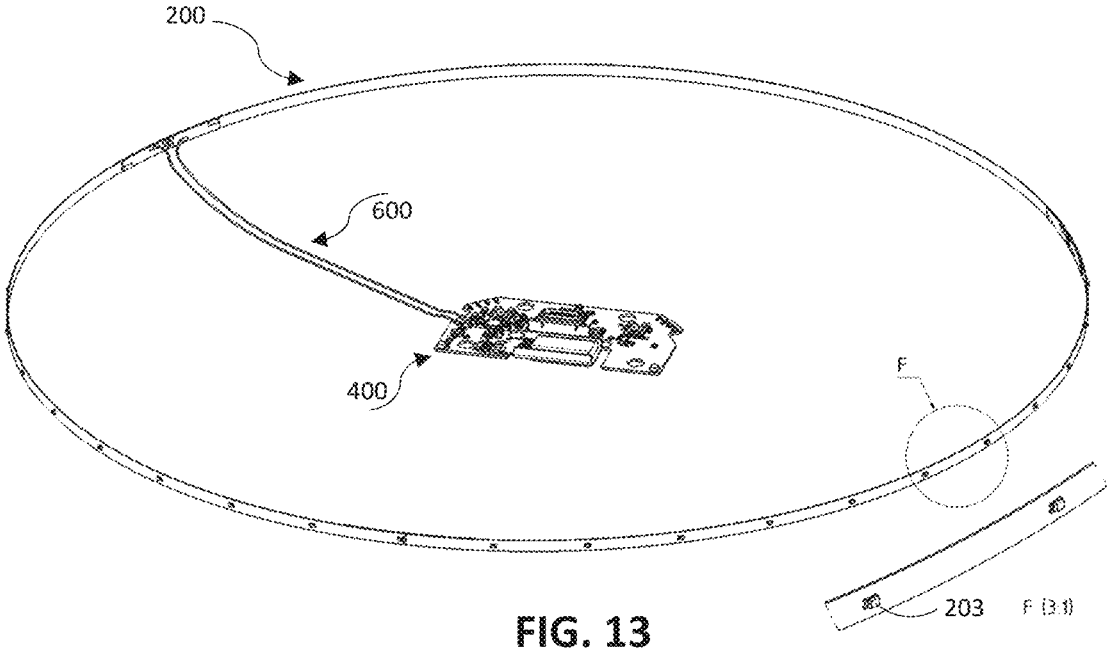
FIG. 13 illustrates a bottom-perspective view of an example flying disc comprising a small number of light blocks, according to some embodiments.
Figure 14:
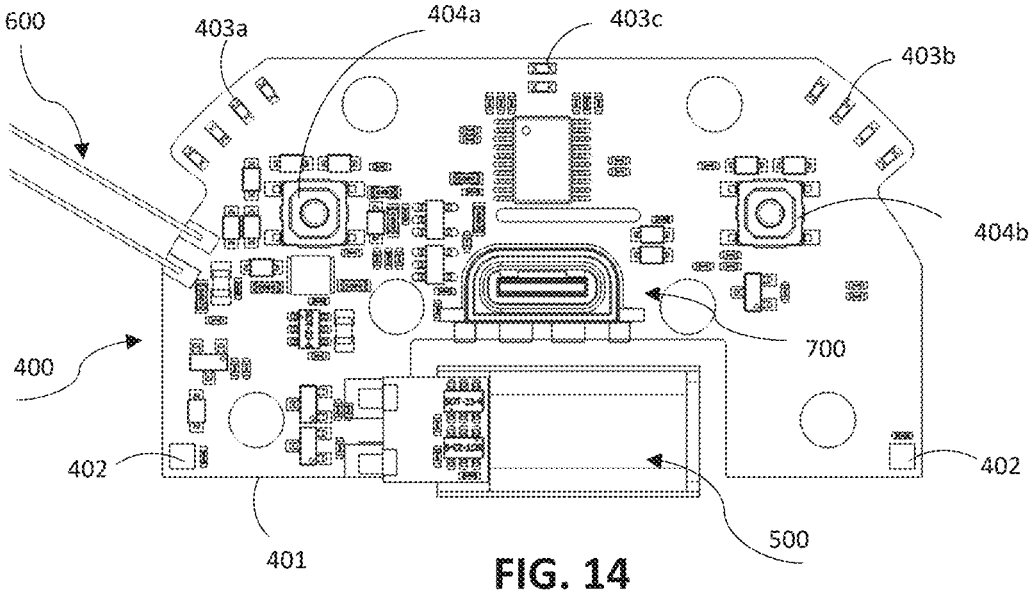
FIG. 14 illustrates an example controller for a flying disc comprising a small number of light blocks, according to some embodiments.

FIG. 13 shows another non-limiting example flying disc comprising a small number of light blocks (e.g., 36) light blocks 203 (e.g., 36 LEDs). The flying disc may comprise one set of electrical wires 600 for connecting the controller 400 to the light strip. FIG. 14 illustrates an example controller 400 for a flying disc comprising a small number of light blocks, according to some embodiments. When the flying disc comprises a large number of light blocks, in some instances, a greater number and/or different circuit components may be needed to power the light strip 200. For example, a larger battery and larger controller may be needed to power a light strip comprising 360 LEDs (FIG. 11) compared to a light strip comprising 36 LEDs (FIG. 13).

In some embodiments, as shown in the figures, one or more components may be included in the example circuit boards regardless of the number of light blocks. For example, both circuit boards 401 of FIGS. 12 and 14 include a controller 400, a battery 500, one or more motion sensors 402, a battery power light indicator 403*c*, a brightness mode selector switch 404*a*, a timer mode selector switch 404*b*, and a charging port 700.

Figure 15:
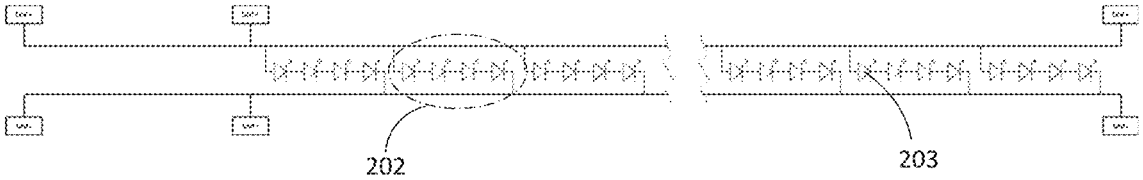
FIG. 15 illustrates an example circuit diagram of a plurality of light blocks connected together, according to some embodiments.

A large number of lights may consume a large amount of current, which may degrade the performance of the flying disc 100 due to, e.g., voltage drops. In some embodiments, a plurality (e.g., 2-10) of light blocks 202 may be connected together, such as shown in FIG. 15, to reduce the current supplied to the light strip 200. In some embodiments, the flying disc 100 may comprise a booster circuit (not shown) to provide more power to the light strip 200 (e.g., when light blocks 202 are connected in series). In some instances, such as when the flying disc 100 comprises a large number of LEDs, multiple sets of electrical wires 600 can be used to reduce the voltage drop across the conductors and make the emitted light brighter throughout the light strip 200. In some embodiments, the light strip 200 may comprise one or more power paths placed along segments of the light strip to power the light blocks 202.

Figure 8:
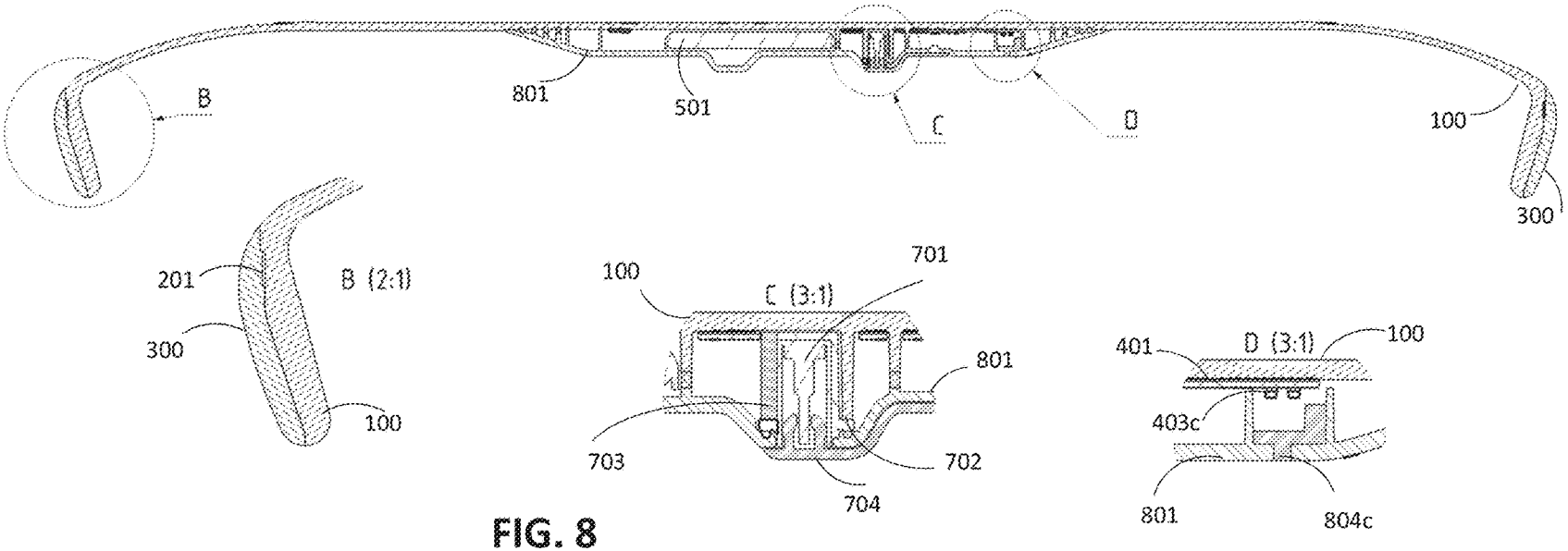
FIG. 8 illustrates cross-sectional views of various parts of an example flying disc, according to some embodiments.
Figure 10:
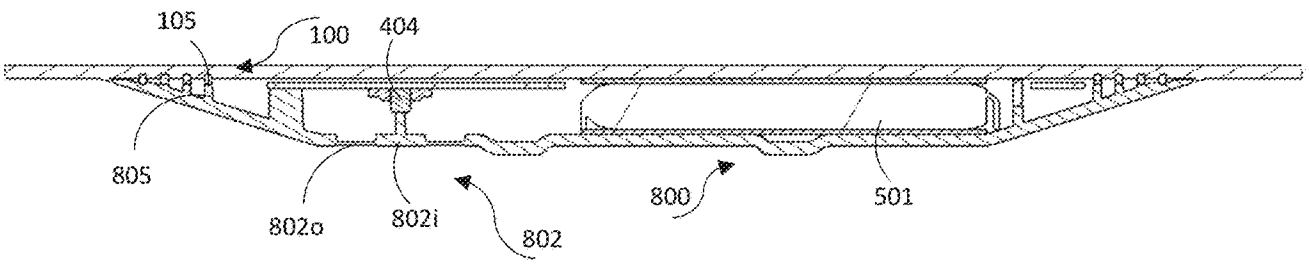
FIG. 10 illustrates a cross-sectional view of a part of an example flying disc, according to some embodiments.
Figure 9:
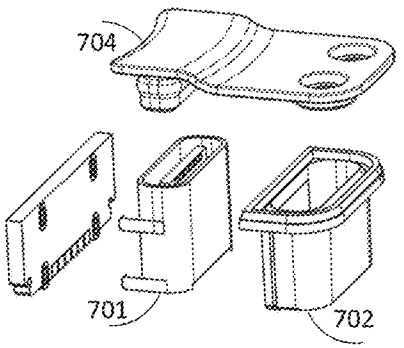
FIG. 9 illustrates a top-perspective view of an example charging port, according to some embodiments.

Referring back to FIG. 6, the light strip guard 300 may be configured to protect the light strip 200, allowing the flying disc to be used for various applications and/or in various environmental conditions. For example, the light strip guard 300 may prevent or reduce water from reaching the light strip 200, thereby allowing the player to play in rainy weather conditions or at the beach near water. As another example, the light strip guard 300 may protect the light strip 200 against external shocks, improving the impact resistance and overall durability of the flying disc 100. By making the flying disc 100 more durable, it can be used for both recreational applications (e.g., as a toy) and professional applications (e.g., ultimate frisbee, disc golf, etc.). The light strip guard 300 may cover the outer region (facing radially outward) of the light strip 200. In some embodiments, the light strip guard 300 may be integral with the body of the flying disc 100. The light strip guard 300 may comprise any transparent or semi-transparent material, such that at least a portion of the light emitted from the light strip 100 is allowed to pass through the light strip guard 300. Example materials include, but are not limited to, polypropylene (PP), low density polyethylene (LDPE), thermoplastic elastomer (TPE), polyurethane (PU), thermoplastic polyurethane (TPU), or a combination thereof. In some embodiments, the light strip 200 (including its flexible circuit board 201) may be attached to the light strip guard 300 and recessed into the rim of the flying disc 100 (as shown in FIG. 8), increasing the amount of protection the light strip guard 300 may provide from external impact.

Figure 16:
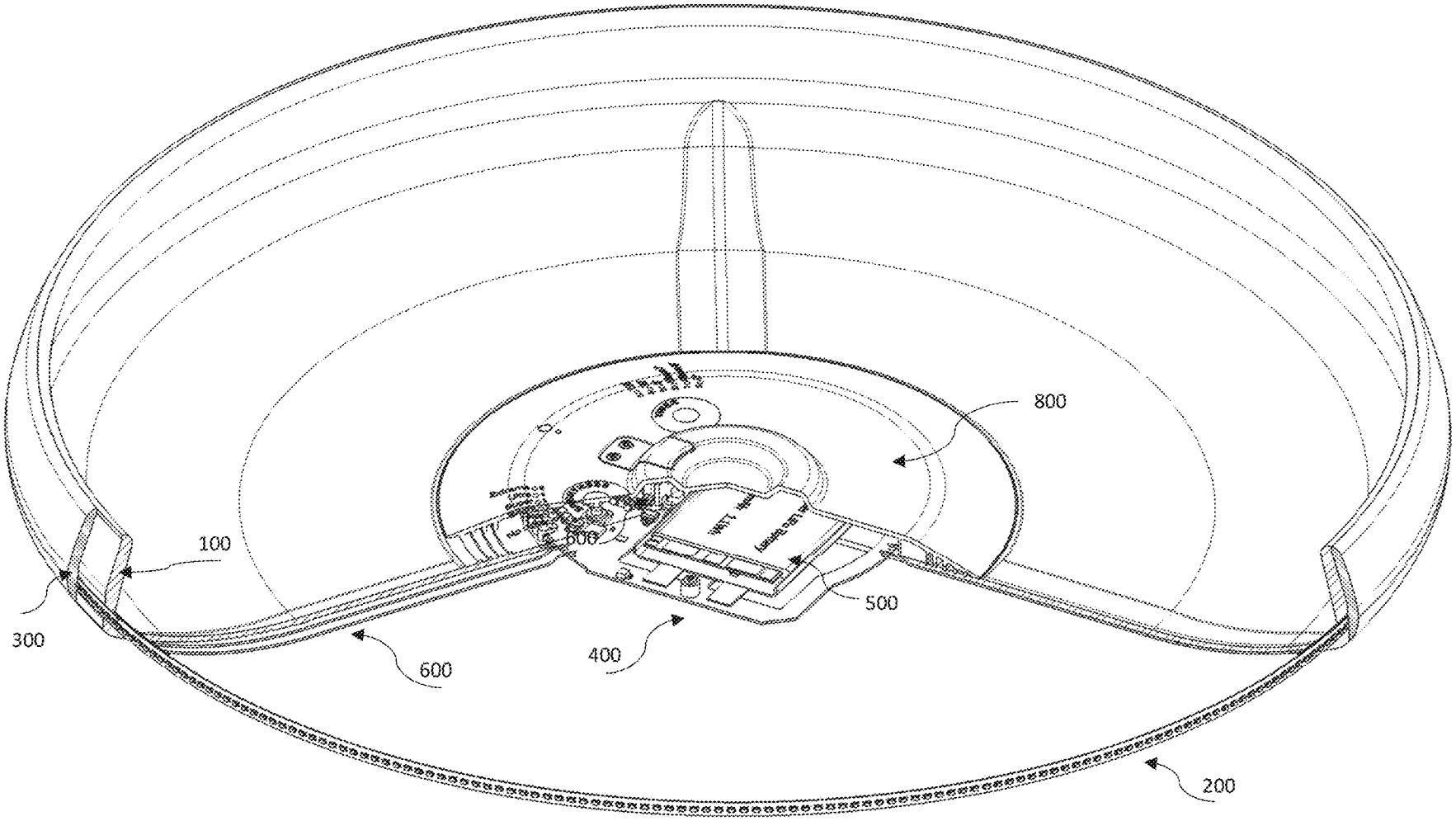
FIG. 16 illustrates a bottom-perspective view of an example flying disc, according to some embodiments.
Figure 17:
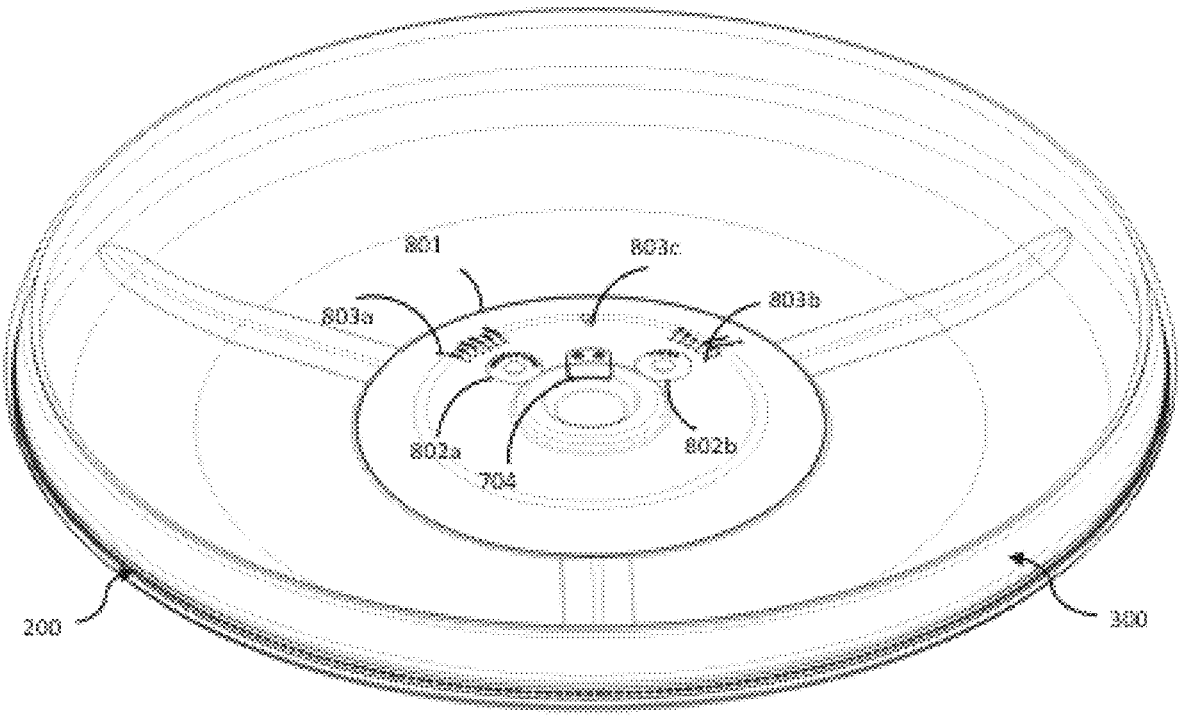
FIG. 17 illustrates a bottom-perspective view of an inner portion of an example flying disc, according to some embodiments.

FIG. 16 illustrates a top-perspective view of an example flying disc with the top shell removed, according to some embodiments. As shown in the figure, the control board 400 is concealed and protected by a compartment 800. FIG. 17 illustrates a top-perspective view of an inner portion of an example flying disc, according to some embodiments.

The compartment 800 may comprise a circuit shell 801, a timer button 802*a*, a brightness selector button 802*b*, a lid, a charging port dust cover 704, and light indicator holes 803*a*, 803*b*, and 803*c*. The circuit shell 801 may be constructed such that it can be securely attached in a watertight manner to the lower shell of the disc body, thus providing good protection (e.g., waterproofing) for the components. Exemplary parts (e.g., battery 500, controller 400, centrifugal switch, for example) are located inside the compartment. In some embodiments, the circuit shell 801 may comprise one or more materials similar to the disc body. In some embodiments, the circuit shell 801 may be attached to or integrated with the disc body so that the circuit shell 801 may protect the inner components of the flying disc 100 from, e.g., water, dust, external impact, etc. For example, the circuit shell 801 and the disc body may be welded together by ultrasonic or heat welding.

The timer button 802*a* may be capable of being manipulated by a player to set or adjust a time period for illuminating at least one light strip 200 including in the flying disc 100. For example, the time period may correspond to the allowed time for the flying disc 100 to transition from flying to stopping. A timing light indicator (which transmits through a timing light indicator hole 803*b*) may illuminate to indicate the time period. For example, the timer button 802*a* may be a knob that the player adjusts to indicate how long the flying disc 100 will remain lit up after stopping flight. In some embodiments, the LEDs may emit a flashing signal for a predetermined period time or distance (e.g., 10" or 7") after stopping flight.

The brightness selector button 802*b* may be capable of being manipulated by a player to set or adjust a brightness level of the light strip 200. For example, the brightness selector button 802*b* may be a dimmable knob used to adjust the brightness of the light strip 200. In some embodiments, the controller 400 may control the amount of power supplied to the light strip 200. The brightness selector button 802*b* may cause the controller to adjust the amount of power supplied to the light strip 200 based on the corresponding manually selection or adjustment of the brightness selector button 802*b*.

Additionally or alternatively, the flying disc may comprise a timer button 802*a* that allows a player to set or adjust the time that the light strip 200 continues to illuminate while or after the flying disc 100 is in motion. In some embodiments, the flying disc 100 may be determined to be in motion based on its motion state. For example, the flying disc 100 may change from a flying state to a stop state. The flying state, the stop state, or both may be determined based on one or more motion sensors (e.g., IMU, accelerometer, GPS sensor, etc.).

Embodiments of the disclosure may comprise one or more sensors for determining one or more motion properties, such as the speed of rotation, airspeed, orbit speed, incline angle, location, etc. of the flying disc 100 when in motion (e.g., flying), at rest (e.g., on the ground or being held in a player's hands). The flying disc 100 may comprise one or more motion sensors including, but not limited to, an IMU, an accelerator, a GPS sensor, a gyroscope, or the like, that determine the motion state of the flying disc 100. The controller 600 may be configured to determine the amount of time the flying disc is in a certain state (e.g., in motion, held by a player, etc.). In some embodiments, the controller 600 may determine whether the time is greater than or equal to a time threshold, and if so, the controller 400 may provide one or more alerts in response. For example, the controller 400 may flash one or more lights, changing the colors of one or more blocks, project one or more audible signals using a speaker included in the flying disc, cause one or more motions in the flying disc (e.g., haptic feedback), or the like. The alert may be used as an audible alert signal to, e.g., locate a lost flying disc. In some embodiments, the alert may be used, e.g., as a reminder to a referee of the rules of a professional team sport involving a flying disc. For example, one rule in professional ultimate frisbee games is that when a player successfully catches a disc, they cannot hold on to the disc for more than 10 seconds. A player may be aware of the 10 seconds only because the player is keeping count of it in his or her head. This method of keeping within the 10 second rule may however be prone to error, and an alert signal from the flying disc 100 may ensure better compliance with game rules. The alert signal may assist players and referees with measuring the exact time associated with a given motion.

Figure 18A:
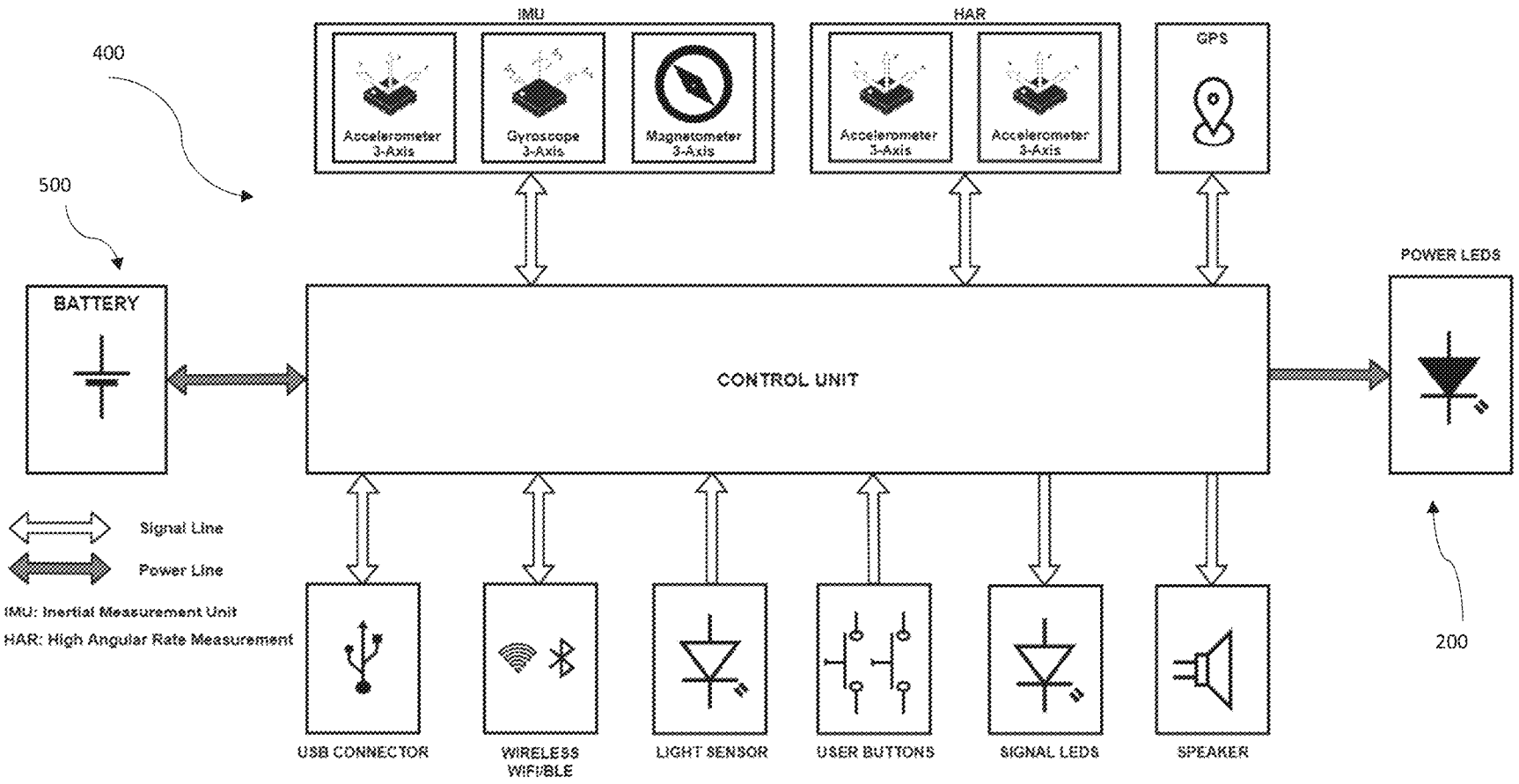
FIGS. 18A and 18B illustrate block diagrams of example controllers, according to some embodiments.
Figure 18B:
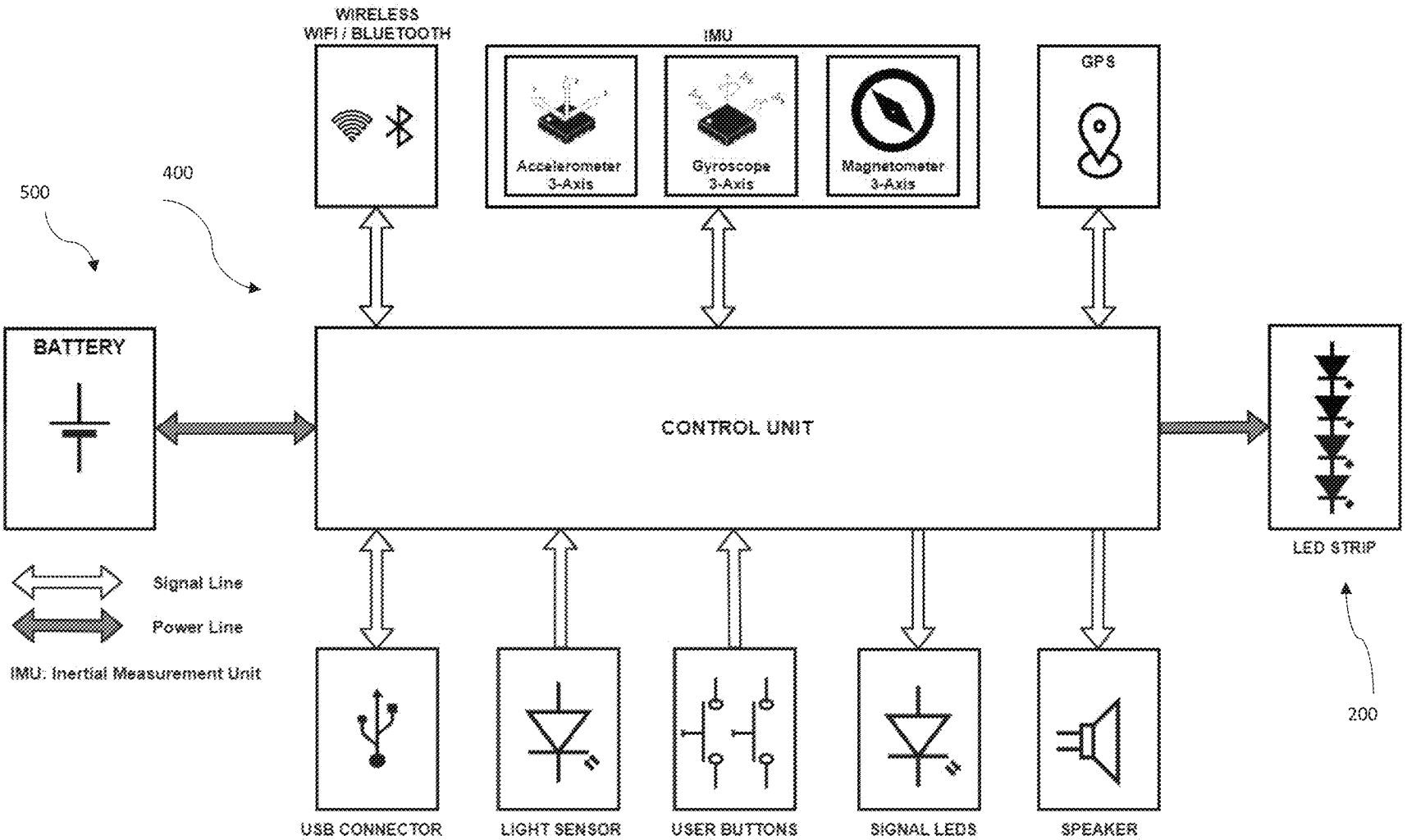

An example controller 400 will now be described with reference to the block diagram of FIGS. 18A and 18B. As discussed above, the controller 400 may control one or more properties of the flying disc 100, such as the properties of the light strip 200, whether and what to provide as indication(s) to the user, whether and what to save in memory, etc. The controller 400 may receive power from a battery 500 and may determine how much power to provide to the light strip 200. Embodiments of the disclosure may include providing power to a plurality of LEDs (e.g., power LEDs), as shown in FIG. 18A, or a plurality of connected LEDs, as shown in FIG. 18B. The power provided to the light strip may be communicated using the electrical wires 600 extending from the center of the flying disc 100 to the rim.

In some embodiments, the controller 400 may receive information from one or more motion sensors (e.g., IMU, accelerometer, gyroscope, magnetometer, GPS sensor, etc.) and/or centrifugal switches to determine whether the light strip 200 should be on or off. As a non-limiting example, an accelerometer may be used to indicate that the flying disc is rotating (indicating that the light strip 200 should be on or off). As one non-limiting example, the flying disc 100 may comprise at least two accelerometers arranged symmetrically with respect to the center of the flying disc 100. When the flying disc 100 rotates, the accelerometers measure the speed of rotation of the disc and sends this information (in the form of an electrical signal) to the controller 400. The controller 400 may automatically turn on at least one light strip 200 in response to receiving the electrical signal. As a result, the light strip 200 may light up automatically every time the flying disc 100 rotates.

The controller 400 may provide an amount of power (including zero power to not turn on the light strip 200) to the light strip 200 based on motion information, such as whether the flying disc is rotating or not. For example, when two centrifugal switches are in the closed state (indicating that the flying disc 100 is rotating), an electrical signal may pass through the two centrifugal switches and be sent to the controller 400. In response to the controller 400 receiving the electrical signal, it may provide power to the light strip 200. In some embodiments, when the centrifugal switches are in an open circuit state, an electrical signal may not pass through the centrifugal switches. The controller 400 may determine that the centrifugal switches are in an open circuit state and may not provide any power to the light strip 200 unless, e.g., a player adjusts the brightness selector button 802*b*. In this manner, since the closed or open state of the centrifugal switches occurs automatically in response to the motion state of the flying disc, the controller may automatically provide or not provide power to the light strips 200. The light strip 200 may automatically turn on the light strips when the flying disc 100 is in motion, or automatically turn off when not in motion. In some embodiments, the centrifugal switches may be arranged symmetrically with respect to the center of the flying disc, such that the controller 400 may automatically turn on the light strips when the centrifugal switches close due to the rotation of the flying disc 100.

As shown in the figure, the flying disc 100 may include other components such as a USB connector to communicate with an external device (such as a battery charger), wireless transmitter to communicate with an external device (such as a smartphone), one or more light sensors to detect lighting conditions, one or more buttons (e.g., timer button, brightness selector button), light indicators (signal LEDs), and a speaker.

Figure 19:
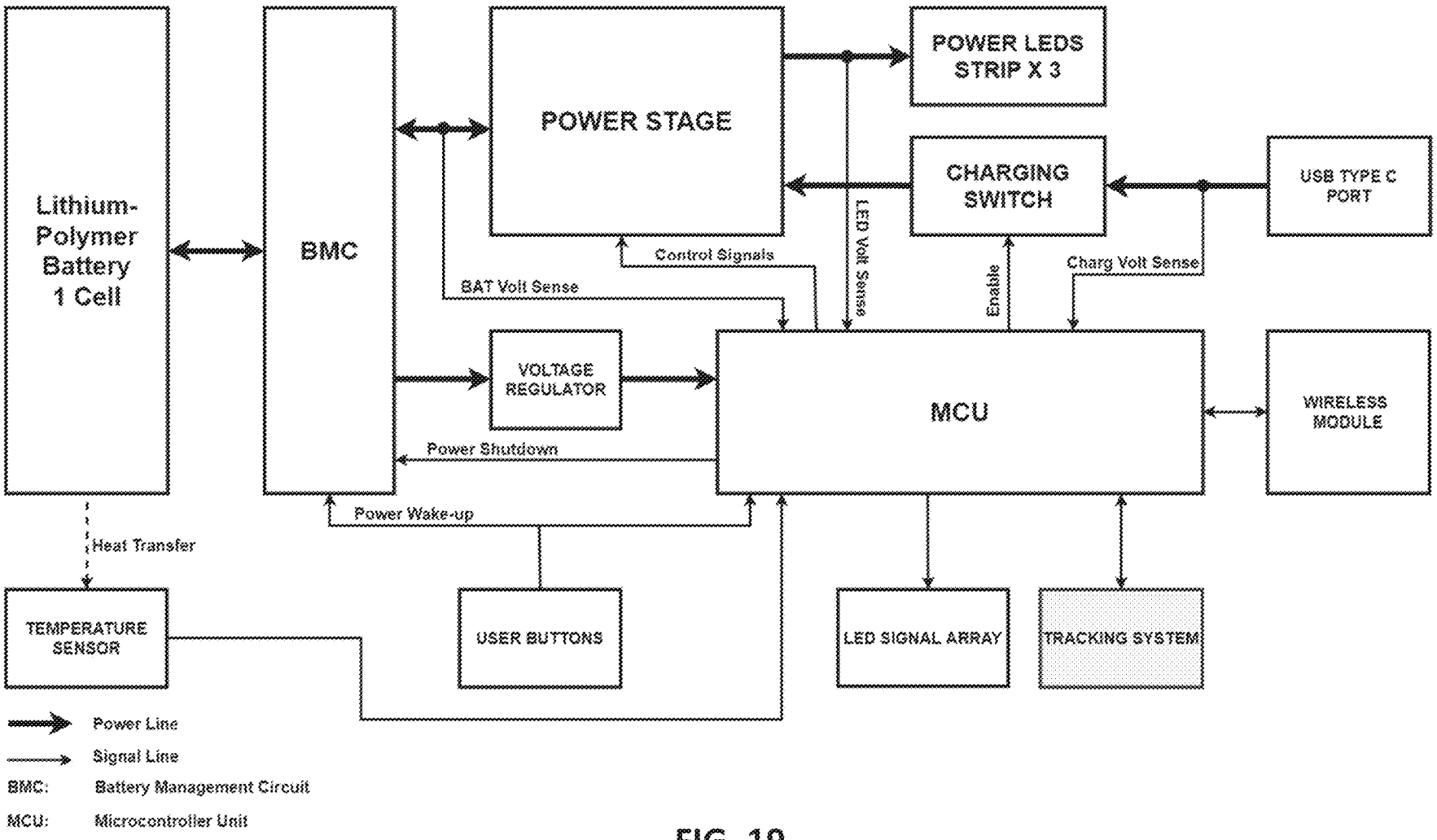
FIG. 19 illustrates a block diagram of example circuits included in a flying disc, according to some embodiments.

Embodiments of the disclosure may comprise other circuits, such as shown in the block diagram of FIG. 19. The circuits of the flying disc 100 may comprise a microcontroller unit (MCU) that determines when a power supply connector is plugged into a charging power. The MCU may recognize the charging voltage and allow a charging current to pass through the charging switch to supply current to a power circuit. A driving circuit may be included in the flying disc for converting the current into a suitable DC power source to charge the battery. In some embodiments, the flying disc 100 may comprise a battery management circuit, where priority is given to the battery 500. In some embodiments, when the flying disc 100 is in use, the energy stored in the battery may be provided to power the MCU for operation, along with power to the light strips 200.

In some embodiments, the MCU may also receive one or more signals, such as from the brightness selector button, centrifugal switches, IMU sensor, and GPS sensor, among others. In some embodiments, the MCU may communicate wirelessly or via a wired connection (e.g., USB connector) to another device.

Figure 20A:
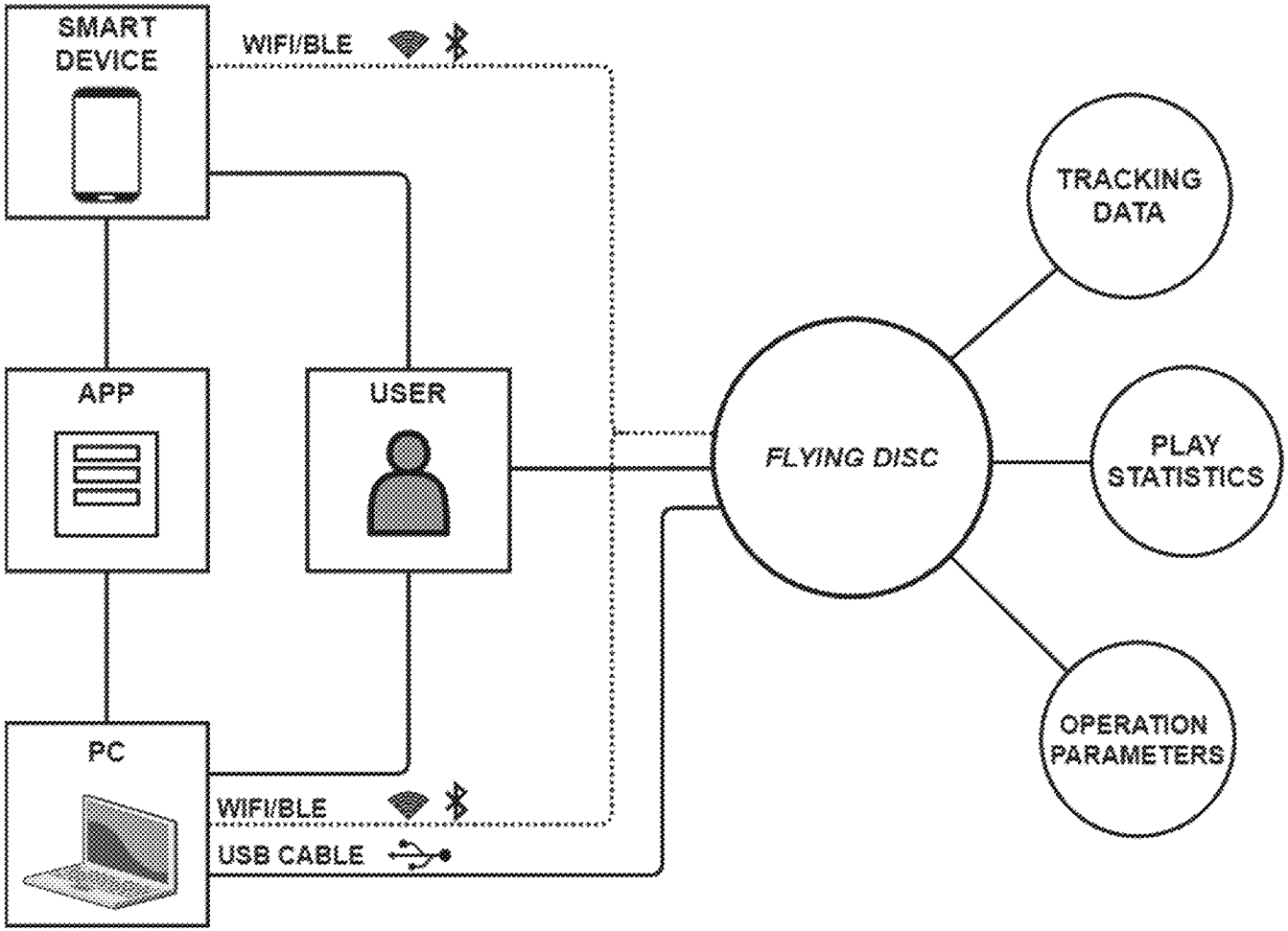
FIGS. 20A and 20B illustrate block diagrams of example communication and computing functions of a flying disc, according to some embodiments.
Figure 20B:
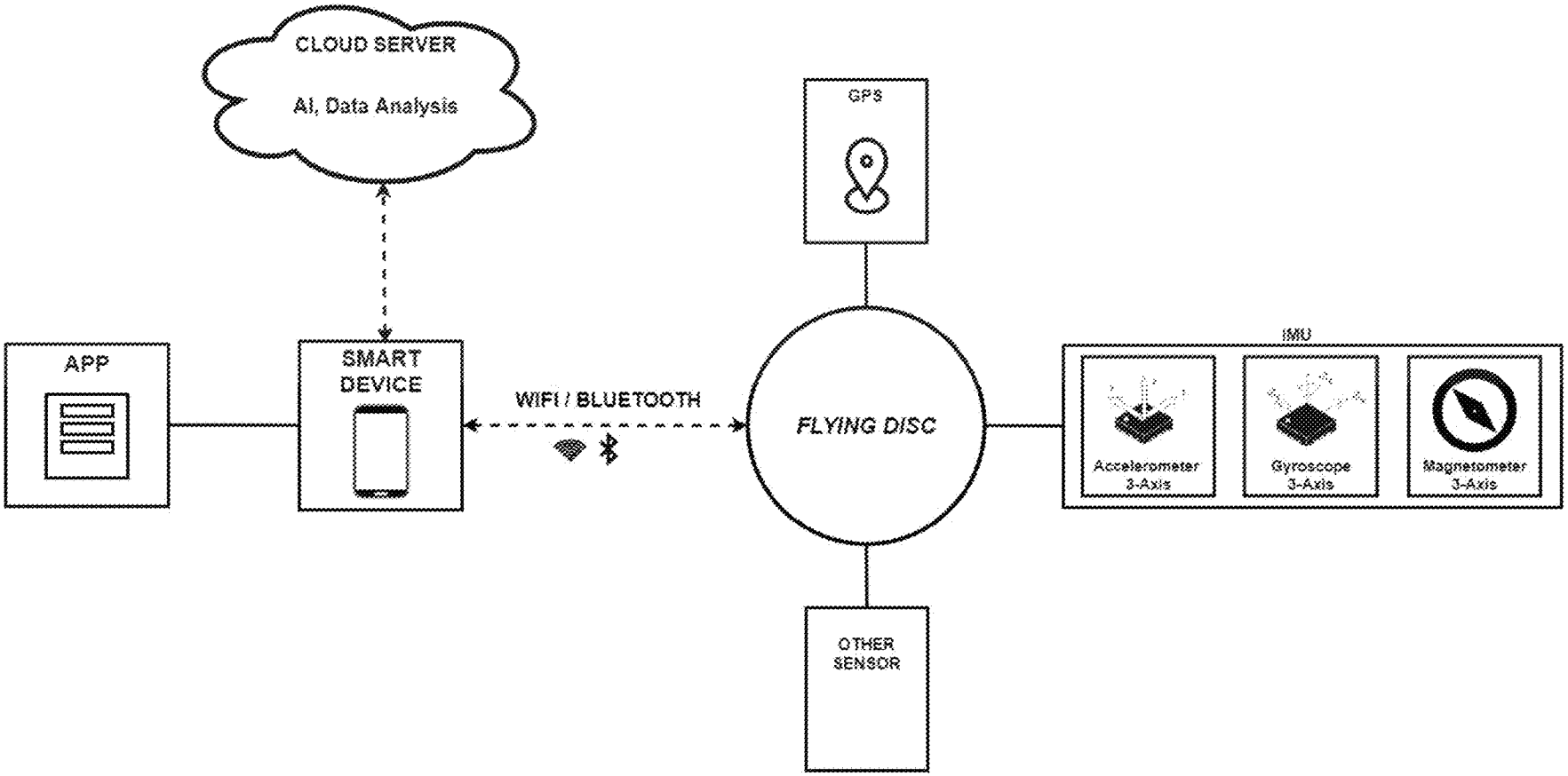

Embodiments of the disclosure may include memory and/or one or more communication circuits. The memory may be used to save one or more motion properties (e.g., flight trajectory, rotation speed, or moving speed) of the flying disc. FIG. 20A illustrates a block diagram of example communication and computing functions of the flying disc, according to some embodiments.

In some embodiments, the communication circuit(s) may be configured to communicate with other devices such as a smartphone or similar portable electronic device via, e.g., a wireless connection (e.g., Bluetooth, WiFi, NFC, or the like) or wired communication (e.g., USB connection). The flying disc 100 may include any type of wireless transmitter that employs any type of wireless technology and/or protocol. As non-limiting examples, the wireless transmitter may be Wi-Fi, Bluetooth, RFID, GSM, CDMA, or Zigbee. The wireless transmitter may be controlled by the MCU. In some embodiments, the wireless transmitter may be a Bluetooth transmitter comprising an internal antenna that broadcasts data using short-wavelength ultra-high frequency (UHF) ratio waves in the ISM band from 2.4 GHz to 2.485 GHz. The Bluetooth transmitter may use a frequency-hopping spread spectrum technique.

The flying disc 100 may measure and communicate tracking data, such as the position, trajectory, rotational velocity, moving speed, or the like, to another device. The flying disc 100 may also measure and communicate play statistics (e.g., number of wins, farthest distance the flying disc 100 was thrown, etc.). The external device may receive the data and display a plot of the trajectory of the thrown flying disc as a map shown on an app to a player. In some embodiments, the plot may be used by the player to determine his or her performance and/or to locate a lost flying disc. In some embodiments, the flying disc 100 may store other information in its memory including, but not limited to, operation parameters, such as the lighting sequence/properties when a play shakes/taps the flying disc according to a pre-determined movement pattern.

In some embodiments, the flying disc 100 may communicate sensor information (including information from the motion sensors (e.g., accelerometer, gyroscope, magnetometer, GPS sensors, etc.) and other sensors (e.g., light sensors) to an external device. For example, the external device may be a smart device such as a smart phone or smart watch that receive sensor information from the flying disc 100 via a wireless connection (WiFi, Bluetooth, or the like). The smart device may store the information, e.g., in a cloud server for analysis and later retrieval. In some embodiments, the smart device may be capable of presenting the information to a player using an app.

Embodiments of the disclosure may include a smart flying disc comprising one or more sensors for locating, tracking, simulating, and/or analyzing the path of the flying disc when thrown by a player. The one or more sensors may include, but are not limited to, one or more accelerometers, one or more gyroscopes, one or more magnetometers, and one or more GPS sensors. The sensor(s) may measure motion data.

An accelerometer may be used to measure the acceleration (rate of change of velocity) of the flying disc 100. In some embodiments, the flying disc 100 may comprise a 3-axis accelerometer that measures the acceleration in three dimensions. The disclosed flying disc 100 may use the accelerometer data to calculate the trajectory when flying. In some embodiments, the accelerometer data may be used, along with the gyroscope data and/or magnetometer data, to determine the orientation of the flying disc 100 in three-dimensional space.

A gyroscope may be used to measure angular speed of the flying disc while flying. In some embodiments, the gyroscope data may be used, along with the accelerometer data and/or magnetometer data, to determine the orientation of the flying disc in three-dimensional space. Embodiments of the disclosure may include any type of gyroscope including, but not limited to, a mechanical gyroscope, a solid-state ring laser, fiber optic, microelectromechanical systems (MEMS), or the like.

A magnetometer may be used to measure the strength and/or direction of the magnetic field on the flying disc 100. In some embodiments, the flying disc 100 may comprise a 3-axis magnetometer that measures the magnetic field of the Earth, and then uses this magnetometer data as a fixed reference for other measurements.

A GPS sensor may be used to measure the location of the flying disc. In some embodiments, the flying disc 100 may include a GPS sensor for allowing a player to locate a lost flying disc 100. In some embodiments, the GPS data may be used to determine and/or recreate the trajectory of the flying disc when flown.

Figure 21:
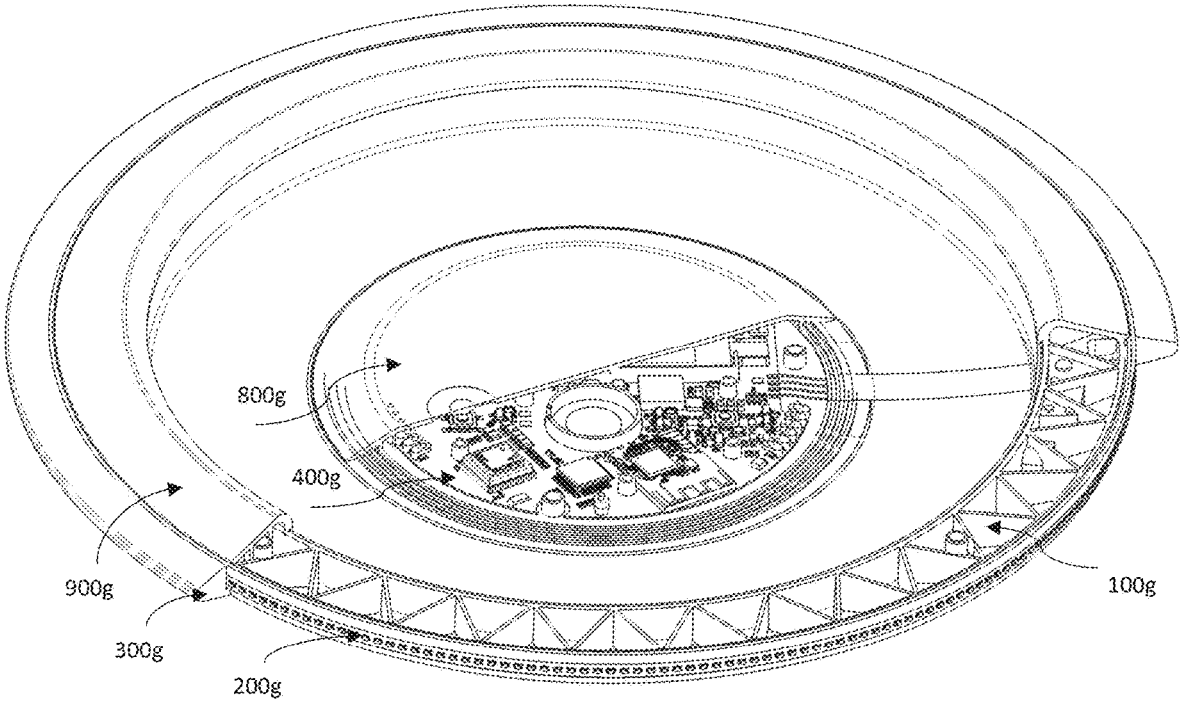
FIG. 21 illustrates a bottom-perspective view of an example disc golf, according to some embodiments.
Figure 22:
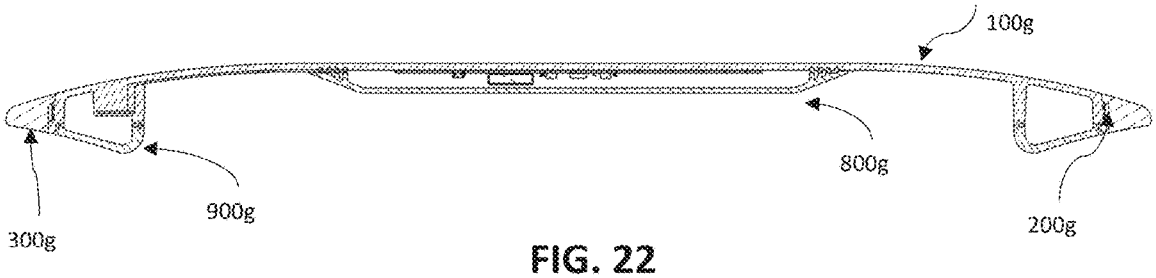
FIG. 22 illustrates a cross-sectional view of an example disc golf, according to some embodiments.

In some embodiments, the smart flying disc 100 may be configured for disc golf applications. FIGS. 21 and 22 illustrate bottom-perspective and cross-sectional views of an example disc golf 100*g*, according to some embodiments. The disc golf 100*g* may comprise a light strip 200*g*, a light strip guard 300*g*, a controller 400*g*, and a compartment 800*g* that have one or more properties similar to the light strip 200, light strip guard 300, controller 400, and compartment 800 disclosed herein.

In some embodiments, the disc golf 100*g* may comprise a lower rim 900*g* having one or more features. For example, the lower rim 900*g* may include a plurality of zigzagged structures, as shown in the figure, suitable for a disc golf.

Figure 23:
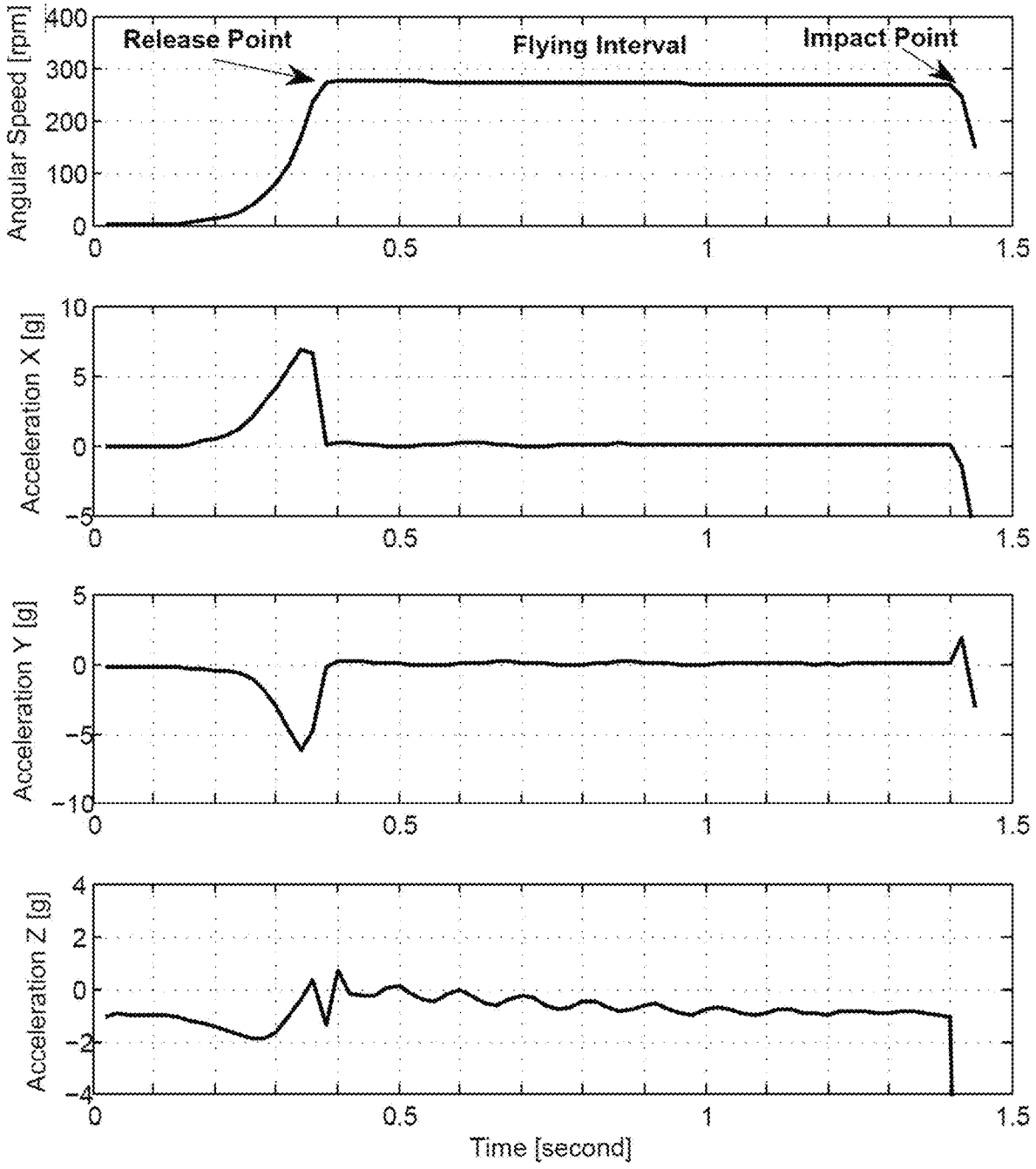
FIG. 23 illustrates example motion data tracked by a flying disc, according to some embodiments.

FIG. 23 illustrates example motion data tracked by a flying disc, according to some embodiments. The figure illustrates the motion data shown after a player has thrown the flying disc once. The bottom three plots illustrate the accelerometer data measured by an accelerometer as a function of time. The controller 400 (or a controller located external from the flying disc) may determine the release point (when the flying disc left the player's hand) and the impact point (when the flying disc touched an object, such as ground) based on the accelerometer data. The analyzed data of the example is shown in the top plot of the figure. For example, the release point is located around 0.4 seconds, and the impact point is located around 1.4 seconds. In some embodiments, the flying time (flying interval or time that the flying disc 100 is flying in the air) may be determined by subtracting the release point time from the impact point time. Here, the flying interval would be 1.0 seconds. Other information may be determined from the motion data. For example, average rotational velocity and distance thrown may be determined from the motion data. In some embodiments, multiple sources of motion data may be analyzed together to determine other motion data. For example, the GPS data and magnetometer data may be analyzed together to determine the trajectory (including the 3D trajectory) of the flying disc 100 when thrown. In some embodiments, the flying disc 100 may relate the trajectory to the user's movements to determine adjustments that may be made to the user's movement to obtain a target trajectory for the flying disc 100.

Although examples of this disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

The invention claimed is:

1. A method comprising:

illuminating, using at least one light strip, light outward in a radial direction from a center of a flying disc when the at least one light strip is on;

covering, using a light strip guard, the at least one light strip;

powering, using a battery, the at least one light strip to turn on the at least one light strip;

controlling, using a controller, whether to turn on the at least one light strip and an amount of power to provide to the at least one light strip; and saving, using a memory of the flying disc, one or more motion properties of the flying disc.

2. The method of claim 1, further comprising:

determining, using one or more light sensors, a light level of an environment; and adjusting the amount of power based on the determined light level.

3. The method of claim 2, wherein the amount of power is above a threshold power level when the light level of the environment is above a brightness threshold and the amount of power is below the threshold power level when the light level of the environment is below the brightness threshold.

4. The method of claim 1, further comprising:

determining the one or more motion properties of the flying disc when thrown.

5. The method of claim 4, wherein the one or more motion properties comprise a location, a rotational velocity or speed, an airspeed, a trajectory, or any combination thereof.

6. The method of claim 1, further comprising:

determining a period of time during which the flying disc is in a certain state; and providing one or more alerts in accordance with a determination that the period of time is greater than or equal to a time duration threshold.

7. The method of claim 6, wherein the certain state comprises: in motion or held by a user, and wherein the one or more alerts comprise: flashing one or more lights in the at least one light strip, changing a color of the one or more lights, sounding one or more audible signals, causing one or more motions in the flying disc, or any combination thereof.

8. The method of claim 1, further comprising:

determining whether the flying disc is in motion; and automatically turning on the at least one light strip in accordance with a determination that the flying disc is in motion.

9. The method of claim 1, further comprising:

determining whether the flying disc is in motion; and automatically turning off the at least one light strip in accordance with a determination that the flying disc is not in motion.

10. The method of claim 1, further comprising:

determining an elapsed time since the flying disc has stopped being in motion; and automatically turning off the at least one light strip in accordance with a determination that the elapsed time is greater than a time duration threshold.

11. The method of claim 1, further comprising:

receiving an input corresponding to illumination properties for the at least one light strip; and setting or adjusting a time period or brightness level of the at least one light strip in accordance with the input.

12. The method of claim 11, wherein the input comprises a manual button push or a communicated wireless signal.

13. The method of claim 1, further comprising:

playing, using a speaker, one or more audible signals.

14. The method of claim 1, further comprising:

determining a state of the flying disc, wherein the state comprises: flying, rotating, being held, or motionless.

15. The method of claim 1, further comprising:

communicating motion information to an external device.

16. The method of claim 1, further comprising:

playing an audible signal in response to receiving a signal indicating that the flying disc has been lost.

17. The method of claim 1, wherein the at least one light strip comprises 6 to 1200 light emitting diodes (LEDs), and wherein the flying disc comprises one or more of: polypropylene (PP), low density polyethylene (LDPE), thermoplastic elastomer (TPE), polyurethane (PU), thermoplastic polyurethane (TPU), high-density polyethylene (HDPE), and thermoplastic elastomer (TPE).

18. A method comprising:

illuminating, using at least one light strip, light outward in a radial direction from a center of a flying disc when the at least one light strip is on;

covering, using a light strip guard, the at least one light strip;

powering, using a battery, the at least one light strip to turn on the at least one light strip;

controlling, using a controller, whether to turn on the at least one light strip and an amount of power to provide to the at least one light strip;

detecting a movement pattern of the flying disc caused by a user;

determining whether the detected movement pattern corresponds to a predetermined movement pattern; and controlling the at least one light strip in accordance with a determination that the detected movement pattern corresponds to the predetermined movement pattern.

19. A method further comprising:

illuminating, using at least one light strip, light outward in a radial direction from a center of a flying disc when the at least one light strip is on;

covering, using a light strip guard, the at least one light strip;

powering, using a battery, the at least one light strip to turn on the at least one light strip;

controlling, using a controller, whether to turn on the at least one light strip and an amount of power to provide to the at least one light strip; and operating the flying disc in an automatic mode or a manual mode, wherein the operating the flying disc in the automatic mode comprises setting or adjusting the amount of power based on information determined by the controller, and wherein the operating the flying disc in the manual mode comprises setting or adjusting the amount of power based on a user input.

* * * * *